US008002567B2

(12) United States Patent
Hara

(10) Patent No.: US 8,002,567 B2
(45) Date of Patent: Aug. 23, 2011

(54) ELECTRICAL CONNECTOR

(75) Inventor: Hiroaki Hara, Tokyo (JP)

(73) Assignee: I-Pex Co., Ltd. (JP)

( * ) Notice: Subject to any disclaimer, the term of this patent is extended or adjusted under 35 U.S.C. 154(b) by 0 days.

(21) Appl. No.: 12/905,343

(22) Filed: Oct. 15, 2010

(65) Prior Publication Data

US 2011/0136365 A1 Jun. 9, 2011

(30) Foreign Application Priority Data

Dec. 4, 2009 (JP) ..... 2009-276772

(51) Int. Cl.
*H01R 13/62* (2006.01)

(52) U.S. Cl. ..... 439/329

(58) Field of Classification Search ..... 439/79, 439/495, 329, 260, 492, 493
See application file for complete search history.

(56) References Cited

U.S. PATENT DOCUMENTS

| | | | | |
|---|---|---|---|---|
| 7,422,472 | B2 * | 9/2008 | Hashiguchi et al. | 439/495 |
| 7,850,473 | B1 * | 12/2010 | Ozeki | 439/260 |
| 2004/0248447 | A1 * | 12/2004 | Aoki | 439/260 |

FOREIGN PATENT DOCUMENTS

| | | | |
|---|---|---|---|
| JP | 2008-52993 | A | 3/2008 |
| JP | 2008-192574 | A | 8/2008 |

OTHER PUBLICATIONS

U.S. Appl. No. 12/791,515, filed Jun. 1, 2010; Kosuke Ozeki; Electrical Connector.

* cited by examiner

*Primary Examiner* — Javaid Nasri
(74) *Attorney, Agent, or Firm* — Studebaker & Brackett PC; Donald R. Studebaker

(57) ABSTRACT

An electrical connector including a housing provided with an opening through which a flat circuit device is inserted into the housing, a plurality of conductive contacts arranged on the housing, and reinforcing mount members provided respectively on end portions of the housing in its longitudinal direction to be used for mounting the housing on a solid circuit board, wherein a holding member is formed in the reinforcing mount member to extend into the housing for engaging with the flat circuit device inserted in the housing to hold the same, a releasing member is formed in the housing to be movable with a first end portion thereof operative to project out of the housing and a second end portion thereof operative to engage with the holding member, and the releasing member is moved so that the second end portion of the releasing member causes the holding member to be released from engagement with the flat circuit device inserted in the housing when the first end portion of the releasing member is pushed toward the inside of the housing under a condition wherein the holding member is put in the engagement with the flat circuit device to hold the same in the housing.

9 Claims, 14 Drawing Sheets

ELECTRICAL CONNECTOR

BACKGROUND OF THE INVENTION

1. Field of the Invention

The present invention relates generally to an electrical connector, and more particularly to an improvement in an electrical connector which has a housing, a plurality of conductive contacts arranged on the housing for coming into press-contact with connecting terminals provided on a flat circuit device, such as a flexible printed circuit board (hereinafter, referred to as an FPC) or a flexible flat cable assembly (hereinafter, referred to as an FFC) inserted in the housing, so as to put the flat circuit device in electrical connection with another electrical device, such as a solid circuit board, and holding means for engaging with the flat circuit device inserted in the housing so as to hold the same to be prevented from getting out of the housing unwillingly.

2. Description of the Prior Art

A flat circuit device, such as a relatively small-sized FPC or FFC, used in electronic apparatus of various kinds is often mounted on a main solid circuit board, on which various electrical parts are directly mounted, with an electrical connector which is fixed to and connected electrically with the main solid circuit board. The electrical connector has a plurality of conductive contacts, an end portion of each of which is connected electrically with a conductive circuit pattern portion formed on the main solid circuit board and which are provided for coming into contact with connecting terminals provided on the flat circuit device, and is operative to cause each of the connecting terminals provided on the flat circuit board to be connected electrically through the conductive contact with the conductive circuit pattern portion formed on the main solid circuit board.

A first type of previously proposed electrical connector used for mounting a flat circuit device, such as an FPC, on a main solid circuit board, is provided with a housing made of insulator, which is fixed on the main solid circuit board and has an opening through which at least a part of the flat circuit device is inserted into the housing. In the housing, a plurality of conductive contacts are provided to be arranged along the opening and connected electrically with circuit terminals provided on the main solid circuit board. These conductive contacts are operative to come into contact respectively with a plurality of connecting terminals provided on the flat circuit device when the flat circuit device is inserted into the housing through the opening provided thereon. The previously proposed electrical connector of the first type is also provided with a conductive shell which covers partially the housing and is grounded to be operative to contribute to adjustment on characteristic impedance of each of the conductive contacts and to shield the conductive contacts in the housing from electromagnetic wave noises coming from the outside. The previously proposed electrical connector of the first type is further provided with an actuator which is provided to be rotatable in regard to the housing so as to engage with each of the conductive contacts arranged in the housing. When the actuator is rotated in a first direction in regard to the housing, an operating portion of each of the conductive contacts is moved by the actuator to put the conductive contact in press-contact with a corresponding one of the connecting terminals provided on the flat circuit device, and then, when the actuator is rotated in a second direction opposite to the first direction in regard to the housing, the conductive contacts put in press-contact with the connecting terminals provided on the flat circuit device are released from the press-contact with the connecting terminals. With the conductive contacts put in press-contact with the connecting terminals provided on the flat circuit device, the flat circuit device is put in electrical connection with the main solid circuit board.

A second type of previously proposed electrical connector used for mounting the flat circuit device on the main solid circuit board is provided with a housing to be fixed on the main solid circuit board, a plurality of conductive contacts and a conductive shell in such a manner as mentioned above but is not provided with an actuator which is rotatable in regard to the housing as mentioned above. In the previously proposed electrical connector of the second type, when the flat circuit device is inserted into the housing through an opening provided thereon, each of the conductive contacts provided in the housing to be arranged along the opening is automatically put in press-contact with a corresponding one of connecting terminals provided on the flat circuit device. That is, the flat circuit device is put in electrical connection with the main solid circuit board by means of only inserting correctly the flat circuit device into the housing through the opening provided thereon.

In the above-mentioned previously proposed electrical connector with or without the actuator rotatable in regard to the housing, when the flat circuit device is inserted into the housing through the opening provided thereon and the conductive contacts provided in the housing are put in press-contact with the connecting terminals provided on the flat circuit device so that the flat circuit device is put in electrical connection with the main solid circuit board, it is required to prevent the flat circuit device inserted in the housing from getting out of the housing unwillingly. It is a matter of course that it is necessary for the flat circuit device inserted in the housing to be held stably so as not to get out of the housing unwillingly in order to keep the conductive contacts provided in the housing properly in a condition of press-contact with the connecting terminals provided on the flat circuit device.

Accordingly, there has been also proposed previously an electrical connector belonging to the above-described first type having the housing, the conductive contact, the conductive shell and the actuator, which is provided with holding means for engaging with a flat circuit device, such as an FPC or FFC, inserted in the housing so as to hold the same to be prevented from getting out of the housing unwillingly, as shown in, for example, the Japanese patent application published before examination under publication number 2008-52993 (hereinafter, referred to as published patent document 1).

In addition, there has been further proposed previously an electrical connector belonging to the above-described second type having the housing, the conductive contact and the conductive shell, which is provided with holding means for engaging with a flat circuit device, such as an FPC or FFC, inserted in the housing so as to hold the same to be prevented from getting out of the housing unwillingly, as shown in, for example, the Japanese patent application published before examination under publication number 2008-192574 (hereinafter, referred to as published patent document 2).

In the electrical connector shown in the published patent document 1, the holding means (a locking portion 11*c*) is formed in a part of the conductive shell (a shield plate 11) to be able to seesaw with an engaging end portion (a nail portion 11*d*) curved to the inside of the conductive shell. The holding means shifts its position in response to a movement of the actuator (an actuator 9) provided to be rotatable in regard to the housing (a housing 3).

Then, when the actuator is rotated in a first direction in regard to the housing after the flat circuit device (an FPC 21) is inserted into a receiving space (an FPC receiving space 34)

provided in the housing, each of the conductive contacts (first contacts 5, second contacts 6) provided in the housing is caused to shift its position by a cam (a cam portion 92 or 93) formed on the actuator so as to be put in press-contact with a corresponding one of connecting terminals provided on the flat circuit device inserted in the housing and the holding means is caused to shift its position by a cam (a cam portion 94) formed on the actuator so as to cause the engaging end portion of the holding means to engage with an engaging portion (a recess 21*a*) formed on the flat circuit device. As a result, the flat circuit device inserted in the housing is held by the holding means to be prevented from getting out of the housing unwillingly.

After that, when the actuator is rotated in a second direction opposite to the first direction in regard to the housing under a condition wherein the engaging end portion of the holding means engages with the engaging portion formed on the flat circuit device, the cam (the cam portion 94) formed on the actuator allows the holding means to release the engaging end portion of the holding means from the engagement with the engaging portion formed on the flat circuit device. As a result, the flat circuit device is put in a condition to be able to get out of the housing.

Further, in the electrical connector shown in the published patent document 2, the conductive shell (a shell 4) is provided to be rotatable to the housing (a housing body 2) and the holding means (a leg portion 46) in the form of a leaf spring is formed in a part of the conductive shell. The holding means has an engaging projection (44) formed at an end of the holding means to be curved to the inside of the conductive shell.

When the flat circuit device (an FPC) is inserted into the housing through the opening (an opening 21) provided thereon under a condition wherein the conductive shell is positioned to keep lying down on the housing so as to be close in its entirety to the housing, each of the conductive contacts (contacts 3 (upper contacts 31, lower contacts 32)) provided in the housing is caused to be put in press-contact with a corresponding one of connecting terminals provided on the flat circuit device inserted in the housing and the engaging projection formed on the holding means is caused to engage with an engaging portion (an FPC engaging hole) provided on the flat circuit device. As a result, the flat circuit device inserted in the housing is held by the holding means to be prevented from getting out of the housing unwillingly.

After that, when the conductive shell is rotated to be positioned to keep rising from the housing under a condition wherein the engaging projection formed on the holding means is put in engagement with the engaging portion formed on the flat circuit device, the holding means formed in the conductive shell shifts its position in response to the movement of the conductive shell so as to release the engaging projection provided on the holding means from the engagement with the engaging portion formed on the flat circuit device. As a result, the flat circuit device is put in a condition to be able to get out of the housing.

In each of the electrical connectors thus proposed previously, which is provided with the holding means operative to prevent the flat circuit device inserted in the housing from getting out of the housing unwillingly, the holding means operative to be put in operation to prevent the flat circuit device inserted in the housing from getting out of the housing unwillingly is provided to shift its position in response to rotational movements of the actuator provided to be rotatable in regard to the housing or the conductive shell for covering partially the housing is provided to be rotatable in regard to the housing and the holding means operative to be put in operation to prevent the flat circuit device inserted in the housing from getting out of the housing unwillingly is formed in a part of the conductive shell.

In the case of the previously proposed electrical connector which has the holding means operative to shift its position in response to the rotational movements of the actuator provided to be rotatable in regard to the housing, the actuator provided to be rotatable in regard to the housing is positively required and this results in problems or disadvantages that the number of constitutive parts of the electrical connector increases undesirably and a production cost of the electrical connector rises disagreeably. In addition, it is necessary for causing the holding means to engage with or disengage from the flat circuit device inserted in the housing to rotate the actuator in regard to the housing. This results in undesirable increase in an open space around the electrical connector.

In the case of the previously proposed electrical connector which has the conductive shell provided to be rotatable in regard to the housing and the holding means formed in the part of the conductive shell, since the conductive shell is operative to rotate in regard to the housing, any part of the conductive shell can not be used for fastening the electrical connector to the main solid circuit board so that a separate holding-down member for fastening the electrical connector to the main solid circuit board is positively required. This results in problems or disadvantages that the number of constitutive parts of the electrical connector increases undesirably and a production cost of the electrical connector rises disagreeably.

Further, in such an electrical connector used for mounting the flat circuit device on the main solid circuit board as described above, necessity of functions of the conductive shell covering partially the housing, in which the conductive shell is operative to contribute to adjustment on characteristic impedance of each of the conductive contacts and shield the conductive contacts in the housing from electromagnetic wave noises coming from the outside, depends on characteristic of a signal transmitted through the connecting terminals provided on the flat circuit device and the conductive contacts. That is, if the characteristic of the signal transmitted through the connecting terminals provided on the flat circuit device and the conductive contacts does not require the functions of the conductive shell, the electrical connector through which the subject signal is transmitted is not provided with the conductive shell. The electrical connector thus constituted without the conductive shell is advantageous in reduction of production cost.

However, the electrical connector constituted without the conductive shell as mentioned above cannot be provided with the holding means formed in the part of the conductive shell which is operative to hold the flat circuit device inserted in the housing so as to preventing the same from getting out of the housing unwillingly.

OBJECTS AND SUMMARY OF THE INVENTION

Accordingly, it is an object of the present invention to provide an electrical connector used for mounting a flat circuit device, such as an FPC or FFC, on a solid circuit board, which comprises a housing made of insulator and provided with an opening through which a flat circuit device is inserted into the housing and a plurality of conductive contacts provided to be arranged on the housing, and which avoids the aforementioned disadvantages encountered with the prior art.

Another object of the present invention is to provide an electrical connector used for mounting a flat circuit device, such as an FPC or FFC, on a solid circuit board, which comprises a housing made of insulator and provided with an opening through which a flat circuit device is inserted into the housing and a plurality of conductive contacts provided to be arranged on the housing, and in which the flat circuit device inserted in the housing can be surely put in holding to be prevented from getting out of the housing unwillingly and then released from the holding so as to be able to get out of the housing with a relatively small number of constitutive parts of the electrical connector resulting in a reduced production cost of the electronic connector.

A further object of the present invention is to provide an electrical connector used for mounting a flat circuit device, such as an FPC or FFC, on a solid circuit board, which comprises a housing made of insulator and provided with an opening through which a flat circuit device is inserted into the housing and a plurality of conductive contacts provided to be arranged on the housing, and in which the flat circuit device inserted in the housing can be surely put in holding to be prevented from getting out of the housing unwillingly and then released from the holding so as to be able to get out of the housing without an actuator provided to be rotatable in regard to the housing and without a conductive shell covering partially the housing.

A still further object of the present invention is to provide an electrical connector used for mounting a flat circuit device, such as an FPC or FFC, on a solid circuit board, which comprises a housing made of insulator and provided with an opening through which a flat circuit device is inserted into the housing, a plurality of conductive contacts provided to be arranged on the housing and a conductive shell covering partially the housing, and in which the flat circuit device inserted in the housing can be surely put in holding to be prevented from getting out of the housing unwillingly and then released from the holding so as to be able to get out of the housing without an actuator provided to be rotatable in regard to the housing and without setting the conductive shell to be rotatable in regard to the housing.

According to the present invention, as claimed in any one of claims, there is provided an electrical connector, which comprises a housing made of insulator to be mounted on a solid circuit board with a first end surface facing the solid circuit board and a second end surface opposite to the first end surface to be open to a space on the solid circuit board and provided thereon with an opening through which a flat circuit device, such as an FPC or FFC, is inserted into the housing, a plurality of conductive contacts arranged on the housing to be electrically connected respectively with circuit terminals provided on the solid circuit board and positioned to correspond respectively to connecting terminals provided on the flat circuit device inserted in the housing through the opening provided thereon, and reinforcing mount members provided respectively on end portions of the housing in a direction along which the conductive contacts are arranged to be used for mounting the housing on the solid circuit board, wherein a holding member is formed in the reinforcing mount member to extend into the housing for engaging with the flat circuit device inserted in the housing to hold the same, a releasing member is formed in the housing to be movable with a first end portion thereof operative to project out of the housing on the side of the second end surface of the housing and a second end portion thereof operative to engage with the holding member, and the releasing member is moved toward the first end surface of the housing so that the second end portion of the releasing member causes the holding member to be released from engagement with the flat circuit device inserted in the housing when the first end portion of the releasing member is pushed toward the inside of the housing under a condition wherein the holding member is put in the engagement with the flat circuit device inserted in the housing.

Especially, in a first example of electronic connector according to the present invention, such as claimed in claim 3, the holding member is provided with an engaging portion for engaging with an engaging edged portion provided on the flat circuit device inserted in the housing to hold the flat circuit device in the housing and a resilient arm portion for supporting the engaging portion to be shiftable in its position in the housing. In the first example, when the first end portion of the releasing member is pushed toward the inside of the housing under a condition wherein the second end portion of the releasing member is put in engagement with the resilient arm portion of the holding member and the engaging portion of the holding member is put in engagement with the engaging edged portion provided on the flat circuit device inserted in the housing, the second end portion of the releasing member deforms resiliently the resilient arm portion of the holding member to shift the engaging portion of the holding member in its position so that the engaging portion of the holding member is released from the engagement with the engaging edged portion provided on the flat circuit device inserted in the housing.

Further, in a second example of electronic connector according to the present invention, such as claimed in claim 6, the holding member is also provided with an engaging portion for engaging with an engaging edged portion provided on the flat circuit device inserted in the housing to hold the flat circuit device in the housing and a resilient arm portion for supporting the engaging portion to be shiftable in its position in the housing in the same manner as the first example. In the second example, an end portion of the engaging portion of the holding member on the side of the opening provided on the housing through which the flat circuit device is inserted into the housing is positioned in close vicinity to a portion of the housing in which the opening is formed.

In the electrical connector thus constituted in accordance with the present invention, when the flat circuit device is inserted into the housing through the opening provided thereon, each of the conductive contacts provided to be arranged on the housing comes into press-contact with the corresponding one of the connecting terminals provided on the flat circuit device inserted in the housing and the holding member formed in the reinforcing mount member engages with the flat circuit device inserted in the housing to hold the same. As a result, the flat circuit device inserted in the housing is prevented from getting out of the housing unwillingly.

Then, when the first end portion of the releasing member is pushed toward the inside of the housing under the condition wherein the holding member is put in engagement with the flat circuit device inserted in the housing to hold the same, the second end portion of the releasing member is put in engagement with the holding member and the first end portion of the releasing member has projected out of the housing, the releasing member is moved so that the holding member is released from the engagement with the flat circuit device by the second end portion of the releasing member. As a result, the flat circuit device inserted in the housing is put in a condition to be able to get out of the housing.

The holding member employed, for example, in each of the first and second examples of electrical connector as mentioned above, has the engaging portion for engaging with the engaging edged portion provided on the flat circuit device inserted in the housing to hold the flat circuit device in the housing and the resilient arm portion for supporting the engaging portion to be shiftable in its position in the housing.

The second end portion of the releasing member is put in engagement with the resilient arm portion of the holding member.

The engaging portion of the holding member employed, for example, in the second example of electrical connector as mentioned above, has the end portion thereof positioned in close vicinity to the port of the housing in which the opening through which the flat circuit device is inserted into the housing is formed.

Accordingly, in the each of the first and second examples of electrical connector as mentioned above, when the flat circuit device is inserted into the housing through the opening provided thereon, the engaging portion of the holding member engages automatically with the engaging edged portion provided on the flat circuit device inserted in the housing to hold the flat circuit device in the housing, so that the flat circuit device is prevented from getting out of the housing unwillingly.

After that, when the first end portion of the releasing member is pushed toward the inside of the housing under the condition wherein the engaging portion of the holding member is put in engagement with the engaging edged portion provided on the flat circuit device inserted in the housing to hold the flat circuit board, the second end portion of the releasing member deforms resiliently the resilient arm portion of the holding member to shift the engaging portion of the holding member in its position and thereby the engaging portion of the holding member is released from the engagement with the engaging edged portion provided on the flat circuit device inserted in the housing, so that the flat circuit device inserted in the housing is put in a condition to be able to get out of the housing.

With the electrical connector thus constituted in accordance with the present invention, as described above, it is not required, for causing the holding member formed in the reinforcing mount member to be put in the engagement with the flat circuit device inserted in the housing to hold the same and then to be released by the releasing member formed in the housing from the engagement with the flat circuit device to put the same in free, to provide on the housing an actuator rotatable in regard to the housing, to provide a conductive shell covering partially the housing or to set a conductive shell to be rotatable in regard to the housing. As a result, the electrical connector according to the present invention can be constituted with a relatively small number of constitutive parts and at a production cost reduced effectively.

In the electrical connector according to the present invention, since the holding member is automatically put in the engagement with the flat circuit device to hold the same in the housing when the flat circuit device is inserted into the housing through the opening provided thereon and then the holding member is released from the engagement with the flat circuit device inserted in the housing when the first end portion of the releasing member, which is put in a condition to project out of the housing on the side of the second end surface of the housing opposite to the first end surface of the housing facing the solid circuit board, is pushed toward the inside of the housing, the holding member can be released from the engagement with the flat circuit device inserted in the housing by extremely simple and easy operations and it is not necessary for carrying out such operations to provide an undesirable open space around the releasing member.

Especially, in the first example of electrical connector according to the present invention, since the second end portion of the releasing member deforms resiliently the resilient arm portion of the holding member to shift the engaging portion of the holding member in its position so that the engaging portion of the holding member is released from the engagement with the engaging edged portion provided on the flat circuit device inserted in the housing when the first end portion of the releasing member is pushed toward the inside of the housing under the condition wherein the engaging portion of the holding member supported to be shiftable in its position by the resilient arm portion of the holding member is put in the engagement with the engaging edged portion provided on the flat circuit device inserted in the housing, the flat circuit device inserted in the housing can be easily put in holding by the holding member and then surely released from the holding by the holding member.

Besides, in the second example of electrical connector according to the present invention, when the flat circuit device inserted in the housing is pulled in a direction from the inside to the outside of the housing under the condition wherein the engaging portion of the holding member supported to be shiftable in its position by the resilient arm portion of the holding member is put in the engagement with the engaging edged portion provided on the flat circuit device to hold the same and thereby the engaging edged portion provided on the flat circuit device pushes the engaging portion of the holding member toward the opening provided on the housing through which the flat circuit device is inserted in the housing, the end portion of the engaging portion of the holding member on the side of the opening provided on the housing comes into press-contact with the part of the housing in which the opening is formed and thereby the engaging portion of the holding member pushed by the engaging portion of the holding member is stopped by the part of the housing in which the opening is formed. As a result, the engaging portion of the holding member pushed by the engaging edged portion of the flat circuit device does not exert substantially any harmful force to the resilient arm portion of the holding member supporting the engaging portion, so that the resilient arm portion of the holding member is prevented from deforming undesirably.

The above, and other objects, features and advantages of the present invention will become apparent from the following detailed description taken in conjunction with the accompanying drawings.

DESCRIPTION OF THE PREFERRED EMBODIMENT

Figure 1:
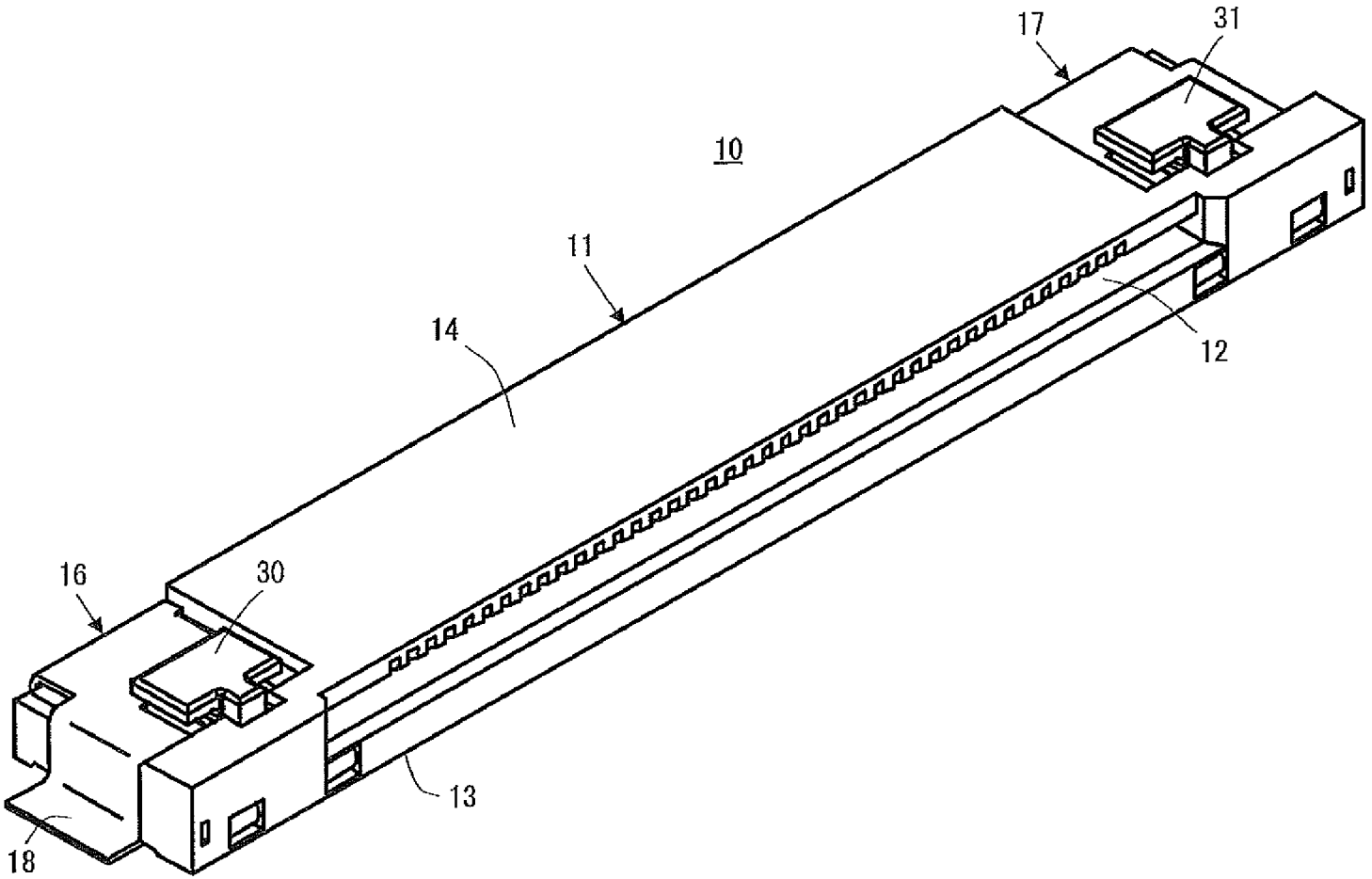
FIG. 1 is a schematic front, top and left side perspective view showing an embodiment of electrical connector according to the present invention.
Figure 2:
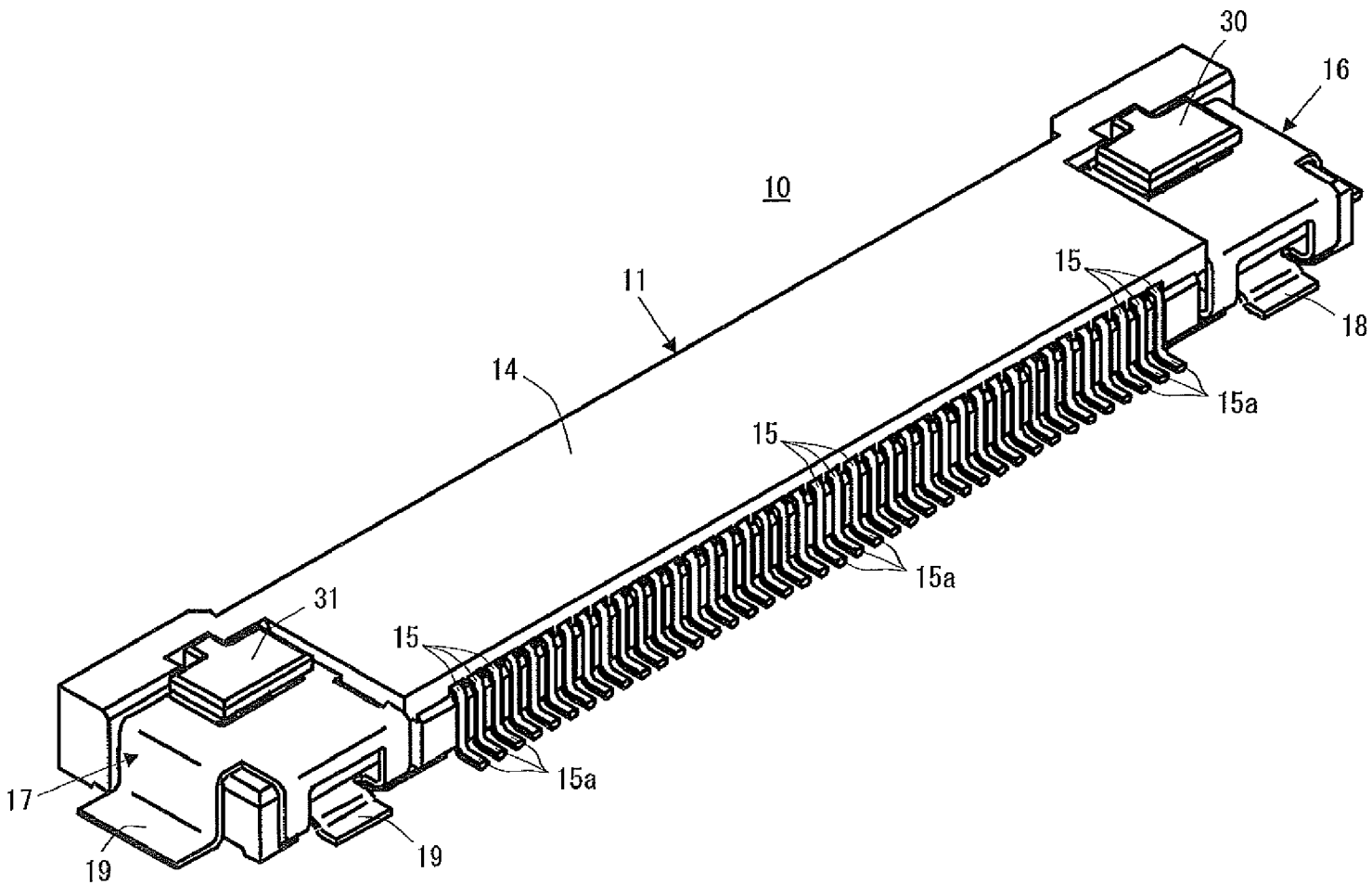
FIG. 2 is a schematic rear, top and left side perspective view showing the embodiment shown in FIG. 1.
Figure 3:
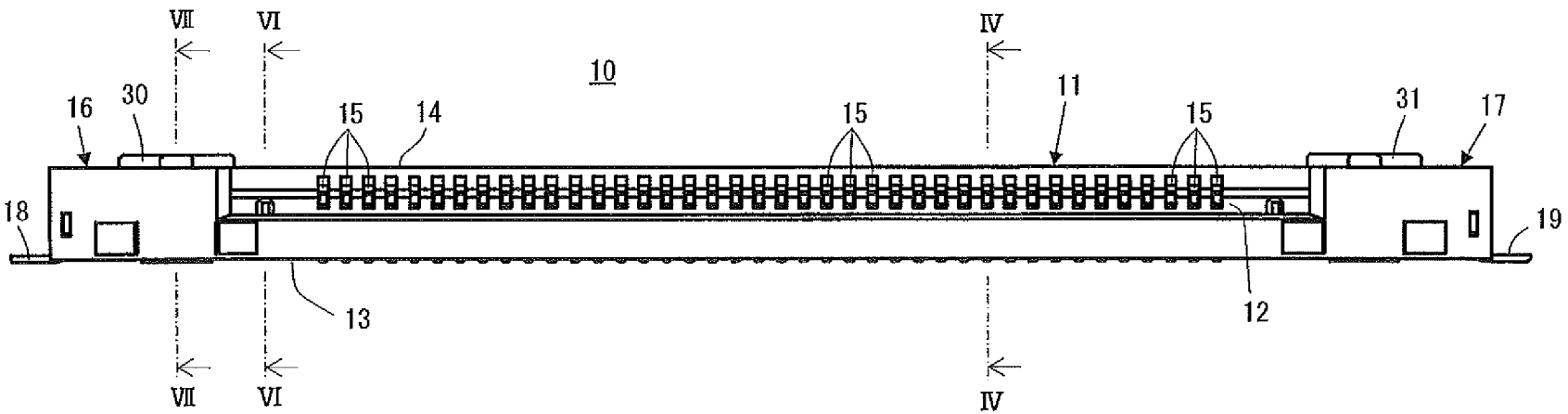
FIG. 3 is a schematic front view showing the embodiment shown in FIG. 1.

Each of FIG. 1 which is a schematic front, top and left side perspective view, FIG. 2 which is a schematic rear, top and right side perspective view and FIG. 3 which is a front view, shows an embodiment of electrical connector according to the present invention.

Referring to FIGS. 1 to 3, an electrical connector 10, which constitutes the embodiment of electrical connector according to the present invention, has a housing 11 made of insulator, such as plastics or the like. The housing 11 is provided in a front end portion thereof with an opening 12 through which a flat circuit device, such as an FFC, is inserted into the housing 11. In the housing 11, a room extending from the opening 12 is formed for accommodating the flat circuit device inserted through the opening 12 into the housing 11.

The housing 11 has a first end surface 13 which is an outer surface of a lower or bottom end portion of the housing 11 in FIGS. 1 to 3 and a second end surface 14 which is an outer surface of an upper or top end portion of the housing 11 in FIGS. 1 to 3 and opposite to the first end surface 13. When the electrical connector 10 is put in practical use for mounting, for example, an FFC constituting the flat circuit device on a solid circuit board in an electronic apparatus (not shown in the drawings), the housing 11 is mounted on the solid circuit board with the first end surface 13 positioned to face the solid circuit board and the second end surface 14 positioned to be open to a space on the solid circuit board.

A plurality of conductive contacts 15, each of which is made of resilient conductive material, are provided on the housing 11 to be arranged in a longitudinal direction of the housing 11. The conductive contacts 15 are operative to be electrically connected respectively with connecting terminals provided on the FFC inserted in the housing 11. To be more concrete, each of the conductive contacts 15 constitutes one of a signal contact, a ground contact and a power supply contact which are electrically connected respectively with a signal connecting terminal, a ground connecting terminal and a power source connecting terminal provide on the FFC inserted in the housing 11.

Figure 4:
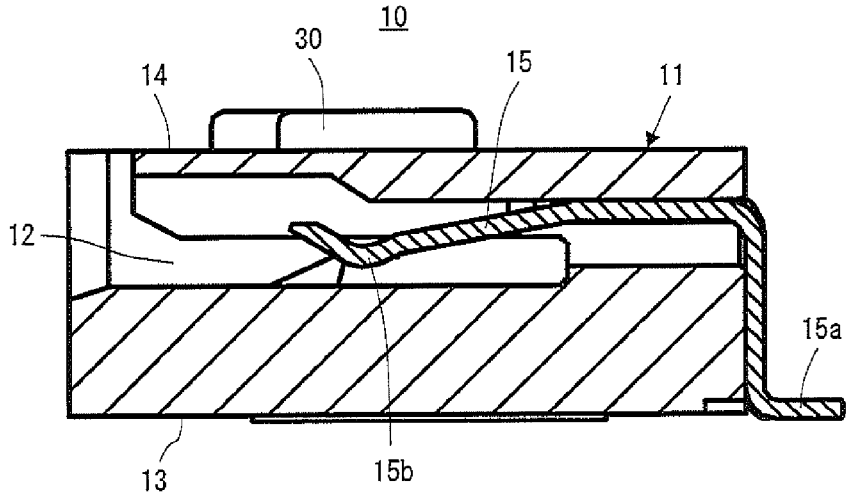
FIG. 4 is a schematic cross sectional view taken along line IV-IV on FIG. 3.

Further, each of the conductive contacts 15 has a connecting terminal portion 15*a* projecting out of a rear end portion of the housing 11 and a press-contacting portion 15*b* extending from the connecting terminal portion 15*a* into the housing 11, as shown in FIG. 4. The connecting terminal portion 15*a* of the conductive contact 15 is connected electrically with one of circuit terminals provided on the solid circuit board on which the housing 11 is mounted and the press-contacting portion 15*b* of the conductive contact 15 is put in press-contact with the connecting terminals provided on the FFC when the FFC is inserted in the housing 11 mounted on the solid circuit board. A main portion of each of the conductive contacts 15 is, for example, thrust into the housing 11 from the rear end portion thereof shown in FIG. 2 when the electrical connector 10 is assembled.

A couple of reinforcing mount members 16 and 17 are provided respectively on both end portions in the longitudinal direction of the housing 11 to be fixed thereto and used for mounting the housing 11 on the solid circuit board. The reinforcing mount member 16 is formed with a resilient metal thin plate subjected to a punch and bend processing to cover partially one of the end portions in the longitudinal direction of the housing 11 on the left side in FIG. 3 (hereinafter, referred to as a left end portion) and provided with a board connecting portion 18 to be fixed to the solid circuit board. Similarly, the reinforcing mount member 17 is formed with a resilient metal thin plate subjected to a punch and bend processing to cover partially the other of the end portions in the longitudinal direction of the housing 11 on the right side in FIG. 3 (hereinafter, referred to as a right end portion) and provided with a board connecting portion 19 to be fixed to the solid circuit board.

When the housing 11 is mounted on the solid circuit board (not shown in the drawings), the housing 11 is put on the solid circuit board with the first end surface 13 facing the solid circuit board and then the board connecting portion 18 of the reinforcing mount member 16 and the board connecting portion 19 of the reinforcing mount member 17 are connected to be fixed by, for example, soldering to the solid circuit board. In addition, the connecting terminal portion 15*a* of each of the conductive contacts 15 is connected electrically by, for example, soldering with the circuit terminal provided on the solid circuit board on which the housing 11 is mounted so that the electrical connector 10 in its entirety is connected electrically with the solid circuit board.

When the FFC constituting the flat circuit device is inserted through the opening 12 into the housing 11 mounted on the solid circuit board, the press-contacting portion 15*b* of each of the conductive contacts 15 positioned in the housing 11 comes into press-contact with a corresponding one of the connecting terminals provided on the FFC inserted in the housing 11 to exert resilient pressure on the same. Therefore, the conductive contacts 15 are connected respectively with the connecting terminals provided on the FFC so that the connecting terminals provided on the FFC inserted in the housing 11 are electrically connected through the conductive contacts 15 with the circuit terminals provided on the solid circuit board on which the housing 11 is mounted.

Figure 5:
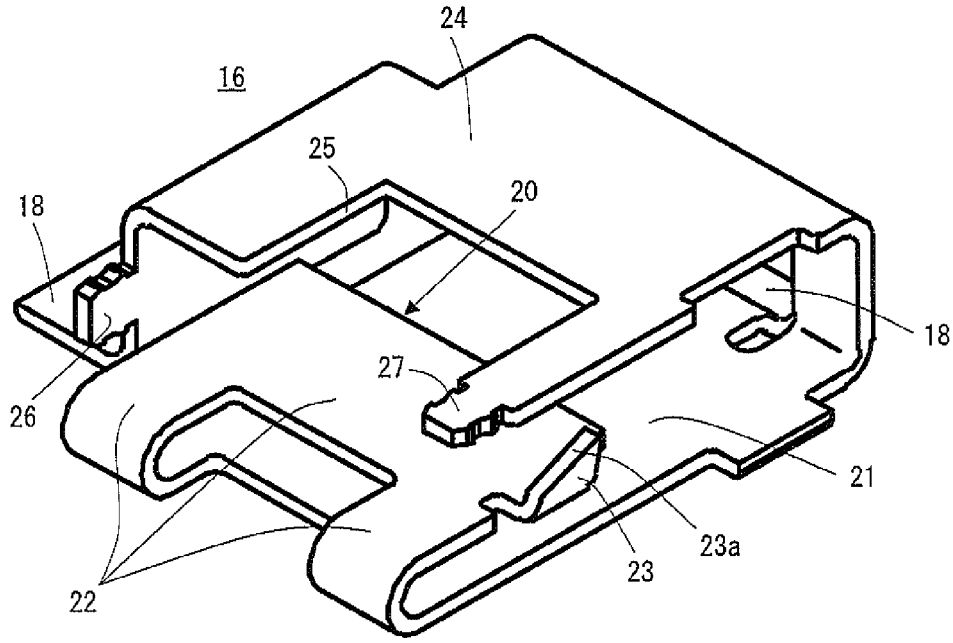
FIG. 5 is a schematic partial perspective view showing a reinforcing mount member provided to be employed in the embodiment shown in FIG. 1.

As shown in FIG. 5, the reinforcing mount member 16 provided to be fixed to the left end portion of the housing 11 is provided with a first plate portion 21 positioned on the side of the first end surface 13 of the housing 11 and a holding member 20 connected with the first plate portion 21 for holding the FFC inserted in the housing 11 through the opening 12 provided thereon at a portion thereof adjacent to the opening 12 provided on the housing 11. The holding member 20 is formed to be adjacent to the opening 12 provided on the housing 11 and comprises a resilient arm portion 22 forming a frame-shape structure, which extends from the first plate portion 21 first toward the front end portion of the housing 11 and then folds back upward to extend toward the rear end portion of the housing 11, and an engaging portion 23 supported to be shiftable in position by the resilient arm portion 22.

The reinforcing mount member 16 is also provided with a second plate portion 24 positioned on the side of the second end surface 14 of the housing 11 to be opposite to the first plate portion 21. The second plate portion 24 is provided with an opening 25 formed therein.

The first plate portion 21, the holding member 20 comprising the resilient arm portion 22 and the engaging portion 23, and the second plate portion 24 as mentioned above are formed in a body in the reinforcing mount member 16.

The engaging portion 23 of the holding member 20 constitutes a projection standing up on the resilient arm portion 22 toward the second plate portion 24. A slanted end plane 23*a* is formed on an upper end of the engaging portion 23 to ascend gradually in a direction along which the FFC is inserted into the housing 11 through the opening 12 provided thereon. The engaging portion 23 is positioned in the inside of the housing 11 for engaging with an engaging edged portion provided on the FFC inserted in the housing 11, as described later.

Figure 6:
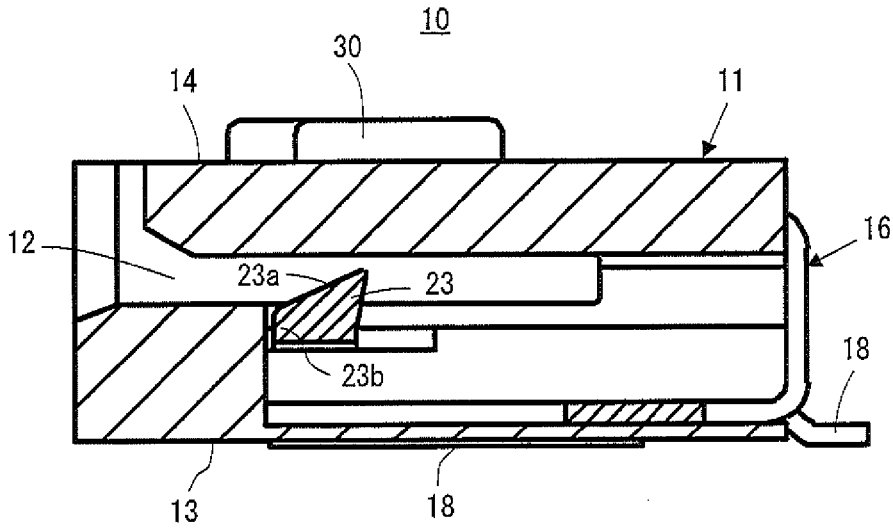
FIG. 6 is a schematic cross sectional view taken along line VI-VI on FIG. 3.

As shown in FIG. 6 which is a cross sectional view taken along line VI-VI on FIG. 3, an uppermost end of the engaging portion 23 is positioned in close vicinity to a part of the housing 11 on the side of the second end surface 14 and an end portion 23*b* of the engaging portion 23 on the side of the opening 12 is positioned in close vicinity to the front end portion of the housing 11 in which the opening 12 is formed.

Further, the reinforcing mount member 16 is provided with engaging projections 26 and 27 operative to be inserted respectively into slits formed on the front end portion of the housing 11 for engaging with the housing 11.

The reinforcing mount member 17 provided to be fixed to the right end portion of the housing 11 is constituted substantially in the same manner as the reinforcing mount member 16. Accordingly, the reinforcing mount member 17 is provided with a holding member comprising a resilient arm portion and an engaging portion, first and second plate portions opposite each other, an opening and engaging projections which correspond respectively to the holding member 20 comprising the resilient arm portion 22 and the engaging portion 23, the first and second plate portions 21 and 24 opposite each other, the opening 25 and engaging projections 26 and 27.

In the housing 11, a releasing member 30 is provided to be movable at a position corresponding to the holding member 20 formed in the reinforcing mount member 16 and a releasing member 31 is also provided to be movable at a position corresponding to the holding member formed in the reinforcing mount member 17. These releasing members 30 and 31 are operative to move for releasing the FFC inserted in the housing 11 from holding by the holding member 20 formed in the reinforcing mount member 16 and the holding member formed in the reinforcing mount member 17.

Figure 7:
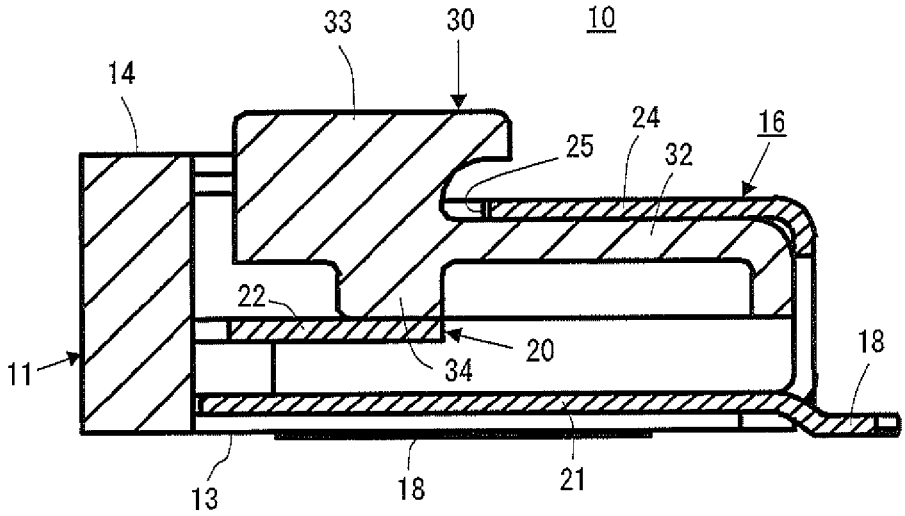
FIG. 7 is a schematic cross sectional view taken along line VII-VII on FIG. 3.

The releasing member 30 is connected through a connecting arm portion 32 with the rear end portion of the housing 11 so as to be formed in a body in the housing 11, as shown in FIG. 7 which is a cross sectional view taken along line VII-VII on FIG. 3. The connecting arm portion 32 is resilient to be able to swing in a first direction from the first end surface 13 of the housing 11 to the second end surface 14 of the housing 11 and a second direction opposite to the first direction. Hereinafter, the first and second directions are referred together to as a vertical direction. With the swinging movements of the connecting arm portion 32, the releasing member 30 is able to move in its entirety up and down in the vertical direction in response to manipulations exerted thereon.

Figure 8:
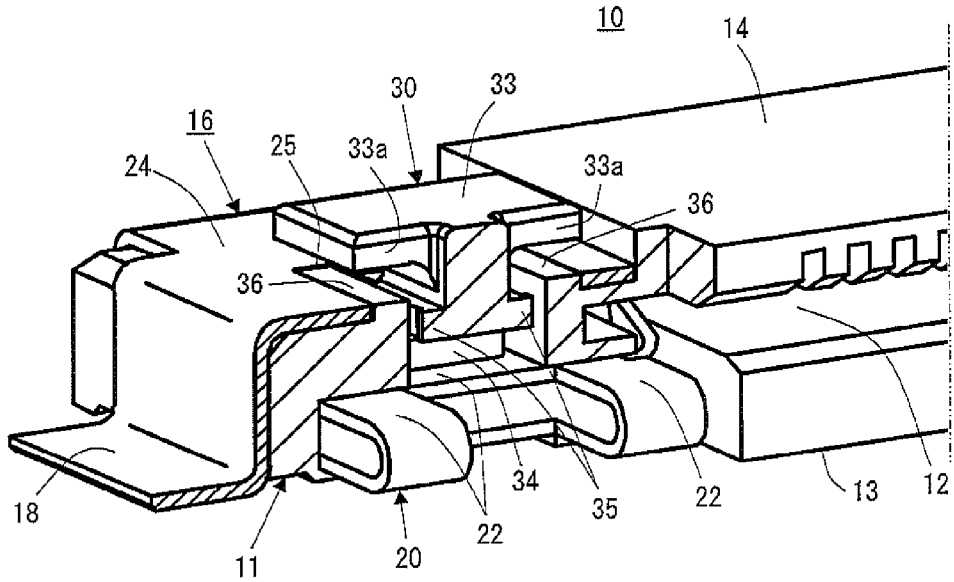
FIG. 8 is a schematic front side partial perspective view including a partial cross section and showing a positional relation between a holding member and a releasing member employed in the embodiment shown in FIG. 1.

As shown also in FIG. 8, the releasing member 30 is provided with a first end portion 33 and a second end portion 34 opposite each other in the vertical direction. The first end portion 33 of the releasing member 30 is operative to project out of the housing 11 through the opening 25 formed in the second plate portion 24 of the reinforcing mount member 16 so as to form a limited plate portion with a first pair of overhangs 33*a* each extending in the direction of the arrangement of the conductive contacts 15. The second end portion 34 of the releasing member 30 is operative to engage with the holding member 20 in the housing 11. In more concrete, the second end portion 34 of the releasing member 30 is operative to come into contact with the resilient arm portion 22 of the holding member 20. The releasing member 30 is further provided with a second pair of overhangs 35 each extending in the direction of the arrangement of the conductive contacts 15 at a middle portion thereof between the first end portion 33 and the second end portion 34. In such a structure as mentioned above, the releasing member 30 is formed in a body in the housing 11 to be movable with the first end portion 33 thereof operative to project out of the housing 11 on the side of the second end surface 14 of the housing 11 and a second end portion 34 thereof operative to engage with the resilient arm portion 22 of the holding member 20 formed in the reinforcing mount member 16.

When the first end portion 33 of the releasing member 30 is pushed toward the inside of the housing 11, the releasing member 30 is moved in its entirely in a direction from the first end portion 33 to the second end portion 34 of the releasing member 30, that is, a direction toward the first end surface 13 of the housing 11, so that the second end portion 34 of the releasing member 30 causes the resilient arm portion 22 of the holding member 20 to deform resiliently. The releasing member 30 is limited in its movement in the direction from the first end portion 33 to the second end portion 34 by the overhangs 33*a* coming into contact with a pair of first stopping portions 36 provided on the housing 11 to be in close vicinity to the releasing member 30. Then, when the first end portion 33 of the releasing member 30 has not been pushed toward the inside of the housing 11, the releasing member 30 is moved in its entirely in a direction from the second end portion 34 to the first end portion 33 by the resilient arm portion 22 of the holding member 20 operative to be restored resiliently to return to the original position.

The releasing member 31 formed in the housing 11 is constituted in the same manner as the releasing member 30 so as to be connected with the rear end portion of the housing 11 through a connecting arm portion 37 (FIGS. 17 and 18) corresponding to the connecting arm portion 32 of the releasing member 30. Accordingly, the releasing member 31 is provided with first and second end portions, a first pair of overhangs and a second pair of overhangs which correspond respectively to the first and second end portions 33 and 34, the first pair of overhangs 33*a* and the second pair of overhangs 35 of the releasing member 30.

The first end portion of the releasing member 31, which corresponds to the first end portion 33 of the releasing member 30, is operative to project out of the housing 11 through an opening formed in the reinforcing mount member 17 on the side of the second end surface 14 of the housing. The second end portion of the releasing member 31, which corresponds to the second end portion 34 of the releasing member 30, is operative to engage with the holding member formed in the reinforcing mount member 17 in the housing 11. In more concrete, the second end portion of the releasing member 31 is operative to come into contact with the resilient arm portion of the holding member formed in the reinforcing mount member 17.

When the first end portion of the releasing member 31, which corresponds to the first end portion 33 of the releasing member 30, is pushed toward the inside of the housing 11, the releasing member 31 is moved in its entirely in a direction from the first end portion to the second end portion of the releasing member 31 in the same manner as the releasing member 30 moved under a condition wherein the first end portion 33 of the releasing member 30 is pushed toward the inside of the housing 11.

A pair of first stopping portions which correspond respectively to the first stopping portions 36 provided for limiting the movement of the releasing member 30 are provided on the housing 11 to be in close vicinity to the releasing member 31 for limiting the movement of the releasing member 31.

As described above, in the electrical connector 10, the holding member 20 formed in the reinforcing mount member 16 and the releasing member 30 engaging with the holding member 20 are provided at the left end portion of the housing 11, and the holding member formed in the reinforcing mount member 17, which corresponds to the holding member 20 formed in the reinforcing mount member 16, and the releasing member 31 engaging with to the holding member formed in the reinforcing mount member 17 are provided at the right end portion of the housing 11.

Figure 9:
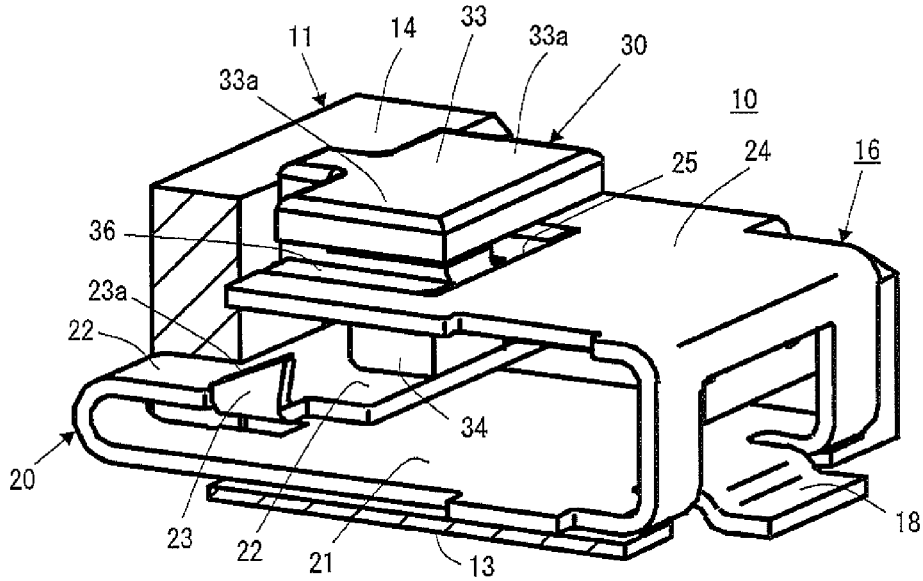
FIG. 9 is a schematic rear side partial perspective view including a partial cross section and showing a positional relation between a holding member and a releasing member employed in the embodiment shown in FIG. 1.
Figure 10:
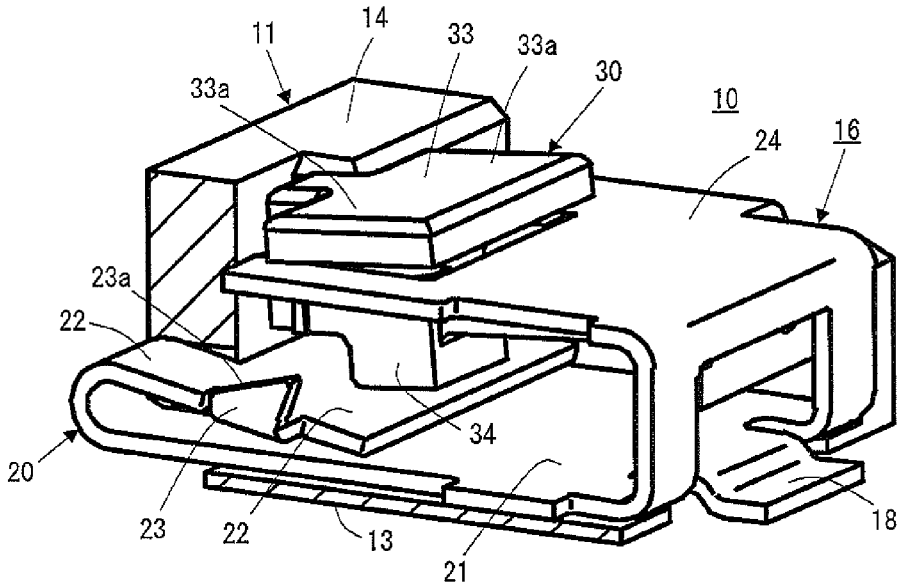
FIG. 10 is a schematic rear side partial perspective view including a partial cross section and showing a positional relation between a holding member and a releasing member employed in the embodiment shown in FIG. 1.

Each of FIGS. 9 and 10 shows a positional relation between the holding member 20 formed in the reinforcing mount member 16 and the releasing member 30 formed in the housing 11 both provided at the left side portion of the housing 11 of the electrical connector 10. In FIG. 9, the releasing member 30, which is moved in its entirety in the direction toward the first end surface 13 of the housing 11 when the first end portion 33 of the releasing member 30 is pushed toward the inside of the housing 11, is not moved in the direction toward the first end surface 13 of the housing 11, and in FIG. 10, the releasing member 30 has been moved in the direction toward the first end surface 13 of the housing 11.

Referring to FIG. 9, the first end portion 33 of the releasing member 30 is not pushed toward the inside of the housing 11. Accordingly, the second end portion 34 of the releasing member 30 is in contact with the resilient arm portion 22 of the holding member 20 so as not to push the same toward the first plate portion 21 of the reinforcing mount member 16 and therefore the resilient arm portion 22 of the holding member 20 is put in a condition not to deform resiliently.

On the other hand, referring to FIG. 10, the first end portion 33 of the releasing member 30 has been pushed toward the inside of the housing 11 so that the releasing member 30 has been moved in its entirety in the direction toward the first end surface 13 of the housing 11. Accordingly, the second end portion 34 of the releasing member 30 is put in a condition to push the resilient arm portion 22 of the holding member 20 toward the first plate portion 21 of the reinforcing mount member 16 so as to cause the resilient arm portion 22 of the holding member 20 to deform resiliently. The engaging portion 23 supported by the resilient arm portion 22 of the holding member 20 is shifted in position to approach the first plate portion 21 of the reinforcing mount member 16 from the position thereof shown in FIG. 9.

The positional relations between the holding member formed in the reinforcing mount member 17 and the releasing member 31 formed in the housing 11 both provided at the right end portion of the housing 11 of the electrical connector 10, are the same as those between the holding member 20 and the releasing member 30 mentioned above.

Figure 11:
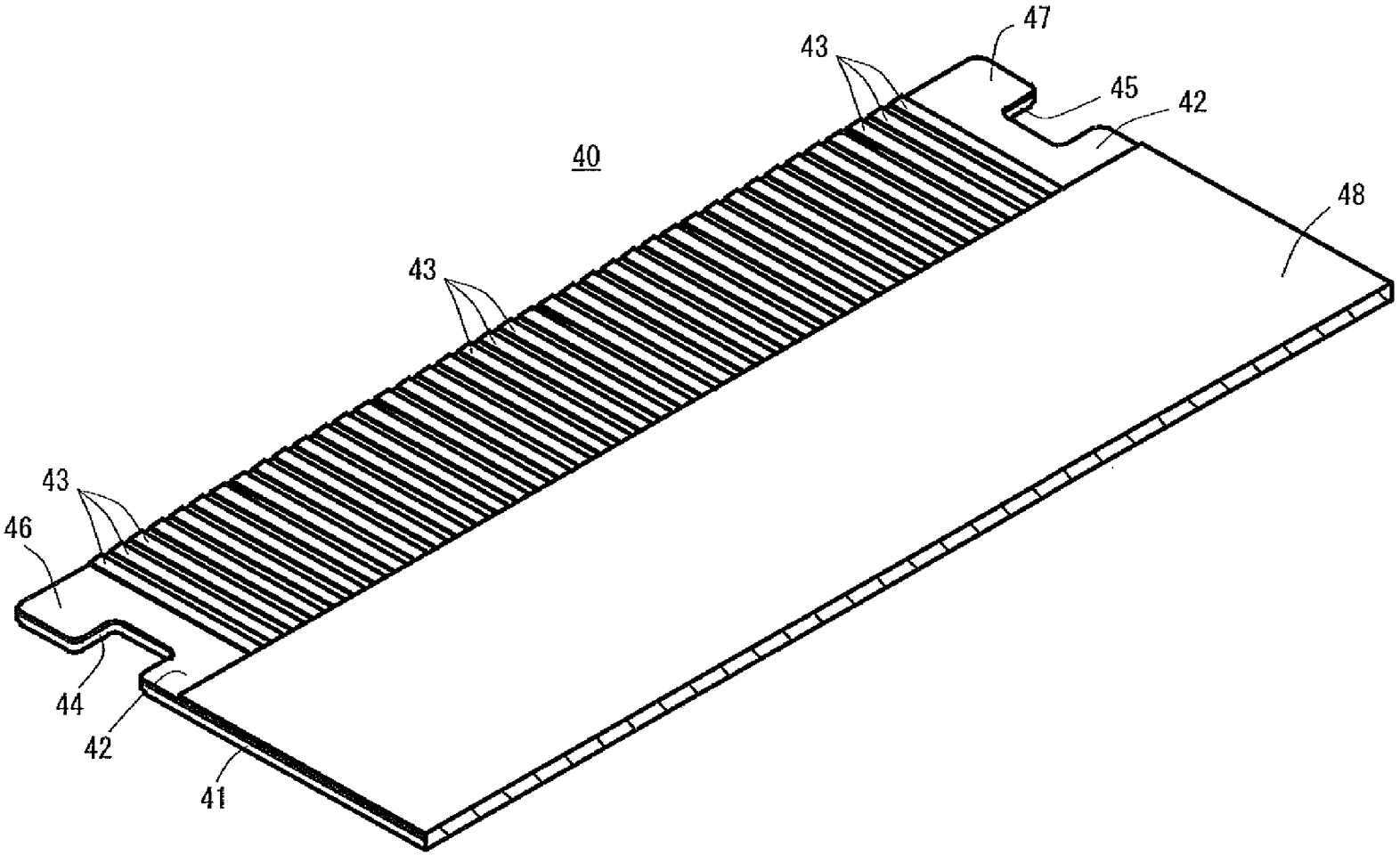
FIG. 11 is a schematic rear, top and left side perspective view showing an FFC which is to be inserted into a housing of the embodiment shown in FIG. 1.
Figure 12:
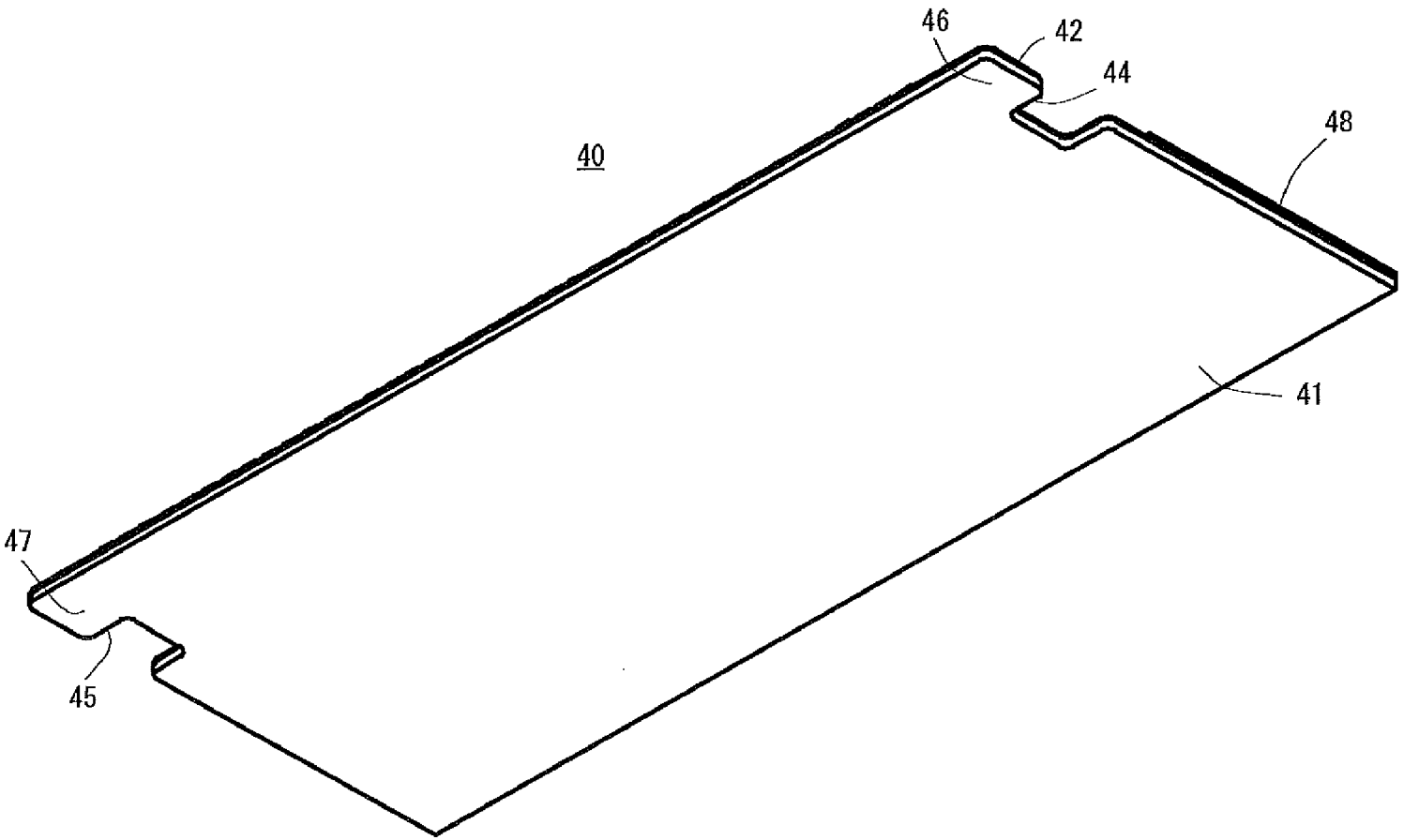
FIG. 12 is a schematic front, bottom and left side perspective view showing an FFC which is to be inserted into a housing of the embodiment shown in FIG. 1.

Each of FIGS. 11 and 12 shows an FFC 40 which is an example of the FFC constituting the flat circuit device to be inserted into the housing 11 of the electrical connector 10 through the opening 12 provided on the housing 11.

The FFC 40 shown in FIGS. 11 and 12 is provided with a reinforcing plate 41. A schematic perspective view of the FFC 40 on the side of a front surface of the reinforcing plate 41 is shown in FIG. 11 and another schematic perspective view of the FFC 40 on the side of a reverse surface of the reinforcing plate 41 is shown in FIG. 12.

Referring to FIGS. 11 and 12, the front surface of the reinforcing plate 41 is covered with an insulating film 42 and a plurality of connecting terminals 43 each made of conductive material and formed into a rectangular plate member are provided to be arranged on the insulating film 42 at an end portion of the reinforcing plate 41. The end portion of the reinforcing plate 41 on which the connecting terminals 43 is provided to be arranged constitutes an end portion of the FFC 40.

Further, a pair of engaging edged recesses 44 and 45 are provided respectively on side end portions of the FFC 40 having the reinforcing plate 41. The engaging edged recesses 44 and 45 are opposite each other with the connecting terminals 43 provided to be arranged on the end portion of the FFC 40 between. A top flat portion 46 is formed at the outside of the engaging edged recesses 44 provided on one of the side end portions of the FFC 40 and another top flat portion 47 is formed at the outside of the engaging edged recesses 45 provided on the other of the side end portions of the FFC 40. Each of the top flat portions 46 and 47 includes a part of front surface of the reinforcing plate 41 covered with the insulating film 42.

It is possible to provide the FFC 40 with a pair of engaging edged holes in place of the engaging edged recesses 44 and 45.

In the FFC 40 thus constituted, the front surface of the reinforcing plate 41 covered with the insulating film 42 is further covered with a coating film 48 except portions thereof on which the connecting terminals 43 are provided to be arranged and in which the engaging edged recesses 44 and 45 and the top flat portions 46 and 47 are formed.

Figure 13:
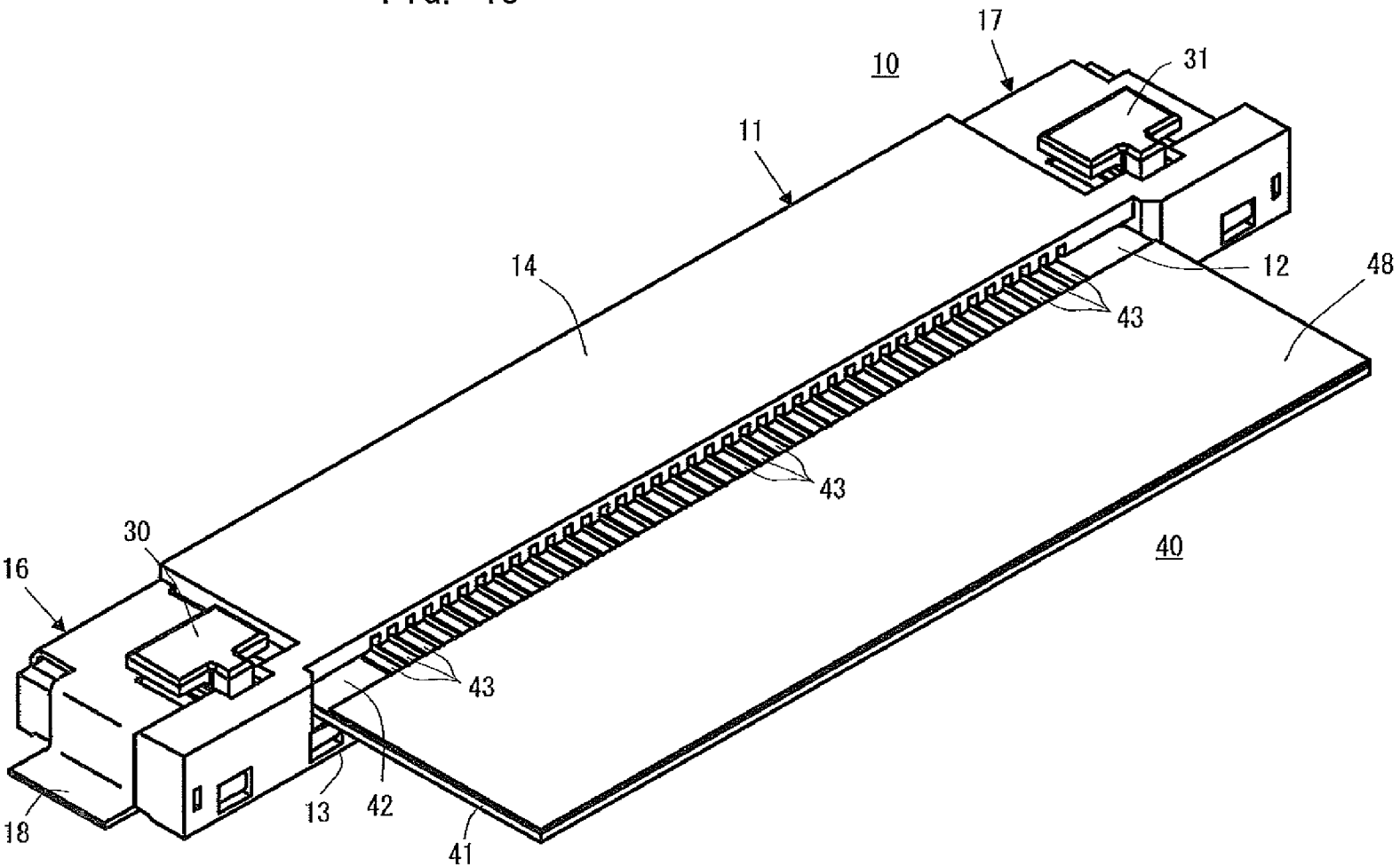
FIG. 13 is a schematic perspective view showing the embodiment shown in FIG. 1 and the FFC which is inserted in the housing of the embodiment.

FIG. 13 shows the electrical connector 10 and the FFC 40 which is inserted in the housing 11 of the electrical connector 10 through the opening 12 provided on the housing 11. In FIG. 13, the front surface of the reinforcing plate 41 covered with the insulating film 42, on which the connecting terminals 43 are provided to be arranged and which is further covered with the coating film 48, is shown.

Figure 14:
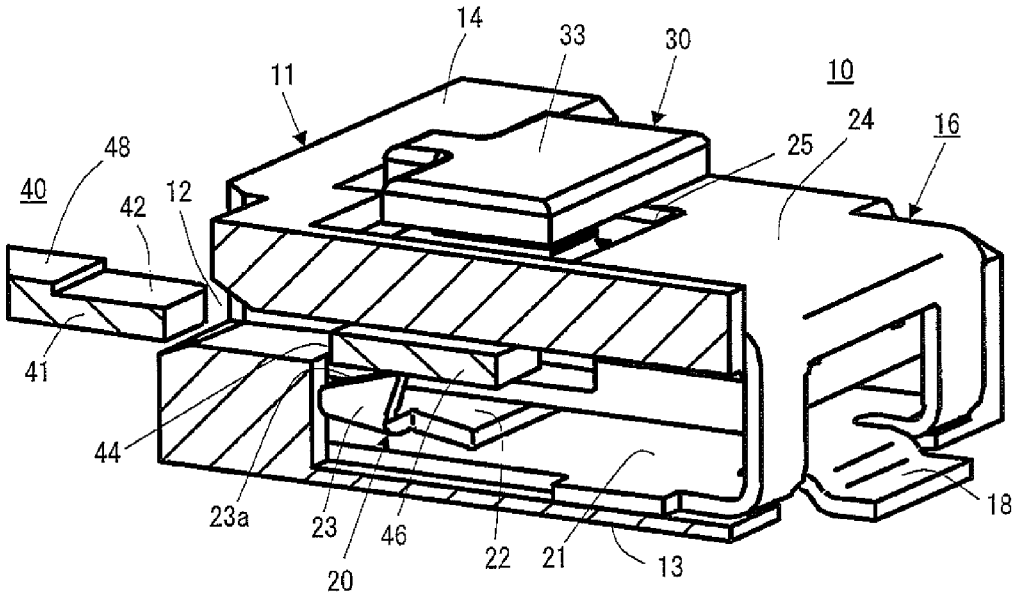
FIG. 14 is a schematic partial perspective view including a partial cross section and showing the embodiment shown in FIG. 1 and the FFC which is put on the way to be inserted into the housing of the embodiment.

When the FFC 40 is inserted into the housing 11 of the electrical connector 10 through the opening 12 provided on the housing 11, as shown in FIG. 13, first the upper end of the engaging portion 23 of the holding member 20 formed in the reinforcing mount member 16, on which the slanted end plane 23*a* is formed, comes into contact with the top flat portion 46 formed on the FFC 40 on the side of the reverse surface of the reinforcing plate 41 at the left end portion of the housing 11, as shown in FIG. 14. At this time, the engaging portion 23 of the holding member 20 is pushed toward the first plate portion 21 of the reinforcing mount member 16, that is, toward the first end surface 13 of the housing 11 by the top flat portion 46 formed on the FFC 40 and thereby the resilient arm portion 22 of the holding member 20 is resiliently deformed so as to shift the engaging portion 23 of the holding member 20 in its position to approach the first plate portion 21 of the reinforcing mount member 16.

In addition, although illustrations are omitted, at the right end portion of the housing 11 also, the upper end of the engaging portion of the holding member formed in the reinforcing mount member 17, on which a slanted end plane is formed, comes into contact with the top flat portion 47 formed on the FFC 40 on the side of the reverse surface of the reinforcing plate 41. At this time, the engaging portion of the holding member formed in the reinforcing mount member 17 is pushed toward the first plate portion of the reinforcing mount member 17, that is, toward the first end surface 13 of the housing 11 by the top flat portion 47 formed on the FFC 40 and thereby the resilient arm portion of the holding member formed in the reinforcing mount member 17 is resiliently deformed so as to shift the engaging portion of the holding member formed in the reinforcing mount member 17 in its position to approach the first plate portion of the reinforcing mount member 17.

Figure 15:
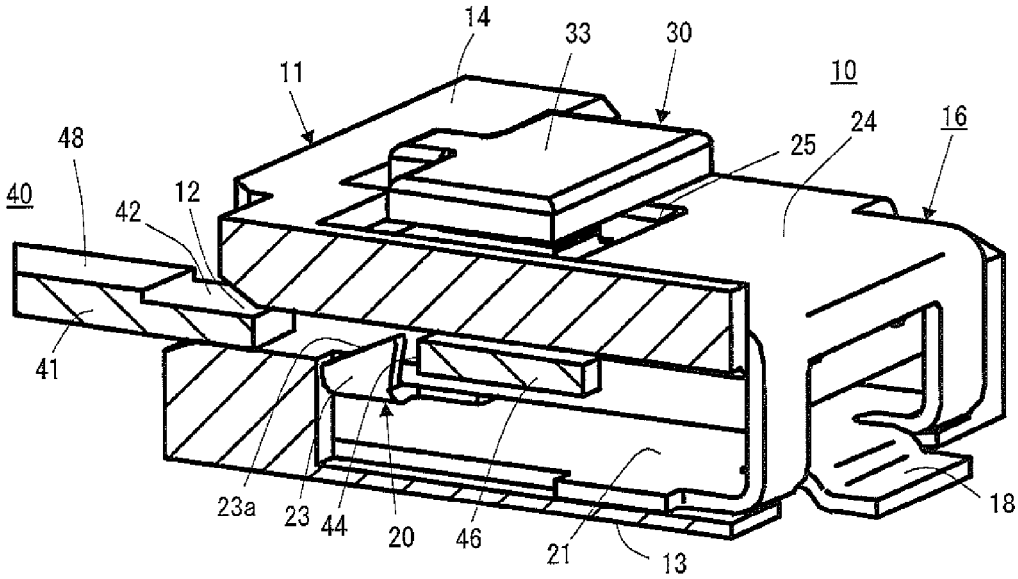
FIG. 15 is a schematic partial perspective view including a partial cross section and showing the embodiment shown in FIG. 1 and the FFC which has been inserted in the housing of the embodiment and held by a holding member formed in a reinforcing mount member provided on the housing.

Then, the FFC 40 is further inserted into the housing 11 to reach a predetermined appropriate position in the housing 11. When the FFC 40 has reached the predetermined appropriate position in the housing 11, the upper end of the engaging portion 23 of the holding member 20 formed in the reinforcing mount member 16, on which the slanted end plane 23*a* is formed, is put out of the top flat portion 46 formed on the FFC 40 and shifted in its position by the resilient arm portion 22 of the holding member 20 restored resiliently to go away from the first plate portion 21 of the reinforcing mount member 16, so that the engaging portion 23 of the holding member 20 engages with the engaging edged recess 44 provided on the FFC 40 for holding the FFC 40, at the left end portion of the housing 11, as shown in FIG. 15.

In addition, although illustrations are omitted, at the right end portion of the housing 11 also, the upper end of the engaging portion of the holding member formed in the reinforcing mount member 17, on which the slanted end plane is formed, is put out of the top flat portion 47 formed on the FFC 40 and shifted in its position by the resilient arm portion of the holding member formed in the reinforcing mount member 17 restored resiliently to go away from the first plate portion 21 of the reinforcing mount member 17, so that the engaging portion of the holding member formed in the reinforcing mount member 17 engages with the engaging edged recess 45 provided on the FFC 40 for holding the FFC 40.

On that occasion, the FFC 40 inserted in the housing 11 has reached the predetermined appropriate position in the housing 11 and held by the holding member 20 formed in the reinforcing mount member 16 fixed to the left end portion of the housing 11 and the holding member formed in the reinforcing mount member 17 fixed to the right end portion of the housing 11 so as to be prevented from getting out from the housing 11 unwillingly. This results in that the FFC 40 is automatically held by the holding member 20 formed in the reinforcing mount member 16 and the holding member formed in the reinforcing mount member 17 so as to be put in a condition to be prevented from getting out from the housing 11 unwillingly only by means of being inserted into the housing 11.

When the FFC 40 inserted in the housing 11 has reached the predetermined appropriate position in the housing 11, the upper end of the engaging portion 23 of the holding member 20 formed in the reinforcing mount member 16 is put out of the top flat portion 46 formed on the FFC 40 and thereby the resilient arm portion 22 of the holding member 20 is restored to its condition prior to resilient deformation so as to hit with resilient force against a portion of the housing 11. As a result, a click of hitting is made when the resilient arm portion 22 of the holding member 20 hits with resilient force against the portion of the housing 11. Similarly, the upper end of the engaging portion of the holding member formed in the reinforcing mount member 17 is put out of the top flat portion 47 formed on the FFC 40 and thereby the resilient arm portion of the holding member formed in the reinforcing mount member 17 is restored to its condition prior to resilient deformation so as to hit with resilient force against a portion of the housing 11. As a result, a click of hitting is made when the resilient arm portion of the holding member formed in the reinforcing mount member 17 hits with resilient force against the portion of the housing 11.

Accordingly, the engagement of the engaging portion 23 of the holding member 20 formed in the reinforcing mount member 16 with the engaging edged recesses 44 provided on the FFC 40 which has reached the predetermined appropriate position in the housing 11 and the engagement of the engaging portion of the holding member formed in the reinforcing mount member 17 with the engaging edged recesses 45 provided on the FFC 40 which has reached the predetermined appropriate position in the housing 11 can be easily confirmed by means of aural check from the outside of the housing 11.

Under a condition wherein the FFC 40 inserted in the housing 11 takes up the predetermined appropriate position in the housing 11 in the manner described above, each of the conductive contacts 15 arranged on the housing 11 comes into resilient press-contact with one of the connecting terminals 43 provided on the FFC 40 on the side of the front surface of the reinforcing plate 41 of the FFC 40. As a result, the connecting terminals 43 provided on the FFC 40 inserted in the housing 11 are electrically connected through the conductive contacts 15 with the circuit terminals provided on the solid circuit board on which the housing 11 is mounted.

When the FFC 40 inserted in the housing 11, which is put in such a condition as taking up the predetermined appropriate position in the housing 11 to be held by the holding members 20 formed in the reinforcing mount member 16 and the engaging portion of the holding member formed in the reinforcing mount member 17, is pulled in a direction from the inside to the outside of the housing 11 and thereby the engaging edged recesses 44 and 45 provided on the FFC 40 push respectively the engaging portion 23 of the holding member 20 formed in the reinforcing mount member 16 and the engaging portion of the holding member formed in the reinforcing mount member 17 toward the opening 12 provided on the housing 11, the end portion 23*b* (FIG. 6) of the engaging portion 23 of the holding members 20 formed in the reinforcing mount member 16 and an end portion of the engaging portion of the holding member formed in the reinforcing mount member 17, each of which is positioned in close vicinity to the front end portion of the housing 11 in which the opening 12 is formed, come into press-contact with the front end portion of the housing 11 and thereby each of the engaging portion 23 of the holding members 20 formed in the reinforcing mount member 16 and the engaging portion of the holding member formed in the reinforcing mount member 17 pushed respectively by the engaging edged recesses 44 and 45 provided on the FFC 40 is stopped by the front end portion of the housing 11 in which the opening 12 is formed. As a result, each of the engaging portion 23 of the holding members 20 formed in the reinforcing mount member 16 and the engaging portion of the holding member formed in the reinforcing mount member 17 pushed respectively by the engaging edged recesses 44 and 45 provided on the FFC 40 does not exert substantially any harmful force to the resilient arm portion 22 supporting the engaging portion 23 of the holding member 20 formed in the reinforcing mount member 16 or the resilient arm portion supporting the engaging portion of the holding member formed in the reinforcing mount member 17, so that each of the resilient arm portion 22 of the holding member 20 formed in the reinforcing mount member 16 and the resilient arm portion of the holding member formed in the reinforcing mount member 17 is prevented from deforming undesirably.

Figure 16:
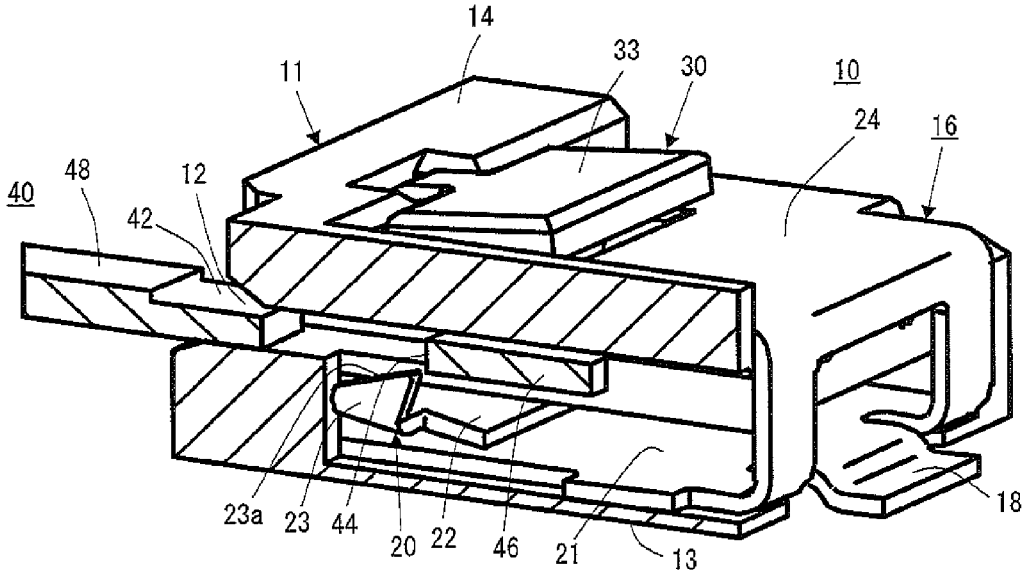
FIG. 16 is a schematic partial perspective view including a partial cross section and showing the embodiment shown in FIG. 1 and the FFC which is released from holding by the holding member formed in the reinforcing mount member provided on the housing.

After that, when the first end portion 33 of the releasing member 30 is pushed toward the inside of the housing 11 at the left end portion of the housing 11, as shown in FIG. 16, the releasing member 30 is moved in its entirely toward the first end surface 13 of the housing 11 to be inclined for causing the connecting arm portion 32 extending from the rear end portion of the housing 11 to swing down resiliently. Thereby, the second end portion 34 of the releasing member 30 causes the resilient arm portion 22 of the holding member 20 formed in the reinforcing mount member 16 to deform resiliently so as to move to approach the first plate portion 21 of the reinforcing mount member 16.

The resilient arm portion 22 of the holding member 20 formed in the reinforcing mount member 16 moved to approach the first plate portion 21 of the reinforcing mount member 16 causes the engaging portion 23 of the holding member 20 formed in the reinforcing mount member 16, which is supported by the resilient arm portion 22 of the holding member 20 formed in the reinforcing mount member 16, to shift in its position to approach the first plate portion 21 of the reinforcing mount member 16. As a result, the engaging portion 23 of the holding member 20 formed in the reinforcing mount member 16 is released from the engagement with the engaging edged recesses 44 provided on the FFC 40.

Similarly, when the first end portion of the releasing member 31 is pushed toward the inside of the housing 11 at the right end portion of the housing 11, the releasing member 31 is moved in its entirely toward the first end surface 13 of the housing 11 to be inclined for causing the connecting arm portion 37 (FIG. 17) extending from the rear end portion of the housing 11 to swing down resiliently. Thereby, the second end portion of the releasing member 31 causes the resilient arm portion of the holding member formed in the reinforcing mount member 17 to deform resiliently so as to move to approach the first plate portion of the reinforcing mount member 17.

The resilient arm portion of the holding member formed in the reinforcing mount member 17 moved to approach the first plate portion of the reinforcing mount member 17 causes the engaging portion of the holding member formed in the reinforcing mount member 17, which is supported by the resilient arm portion of the holding member formed in the reinforcing mount member 17, to shift in its position to approach the first plate portion of the reinforcing mount member 17. As a result, the engaging portion of the holding member formed in the reinforcing mount member 17 is released from the engagement with the engaging edged recesses 45 provided on the FFC 40.

With the first end portion 33 of the releasing member 30 pushed toward the inside of the housing 11 at the left end portion of the housing 11 and the first end portion of the releasing member 31 pushed toward the inside of the housing 11 at the right end portion of the housing 11, the FFC 40 inserted in the housing 11 is put in a condition to be able to get out of the housing 11 appropriately.

In the case where the engaging edged holes are provided on the FFC 40 in place of the engaging edged recesses 44 and 45, the FFC 40 inserted in the housing 11 is also held by the holding member 20 formed in the reinforcing mount member 16 and the holding member formed in the reinforcing mount member 17 and then released from the holding by the holding members 20 formed in the reinforcing mount member 16 and the holding member formed in the reinforcing mount member 17 in the same manner as mentioned above.

Figure 17:
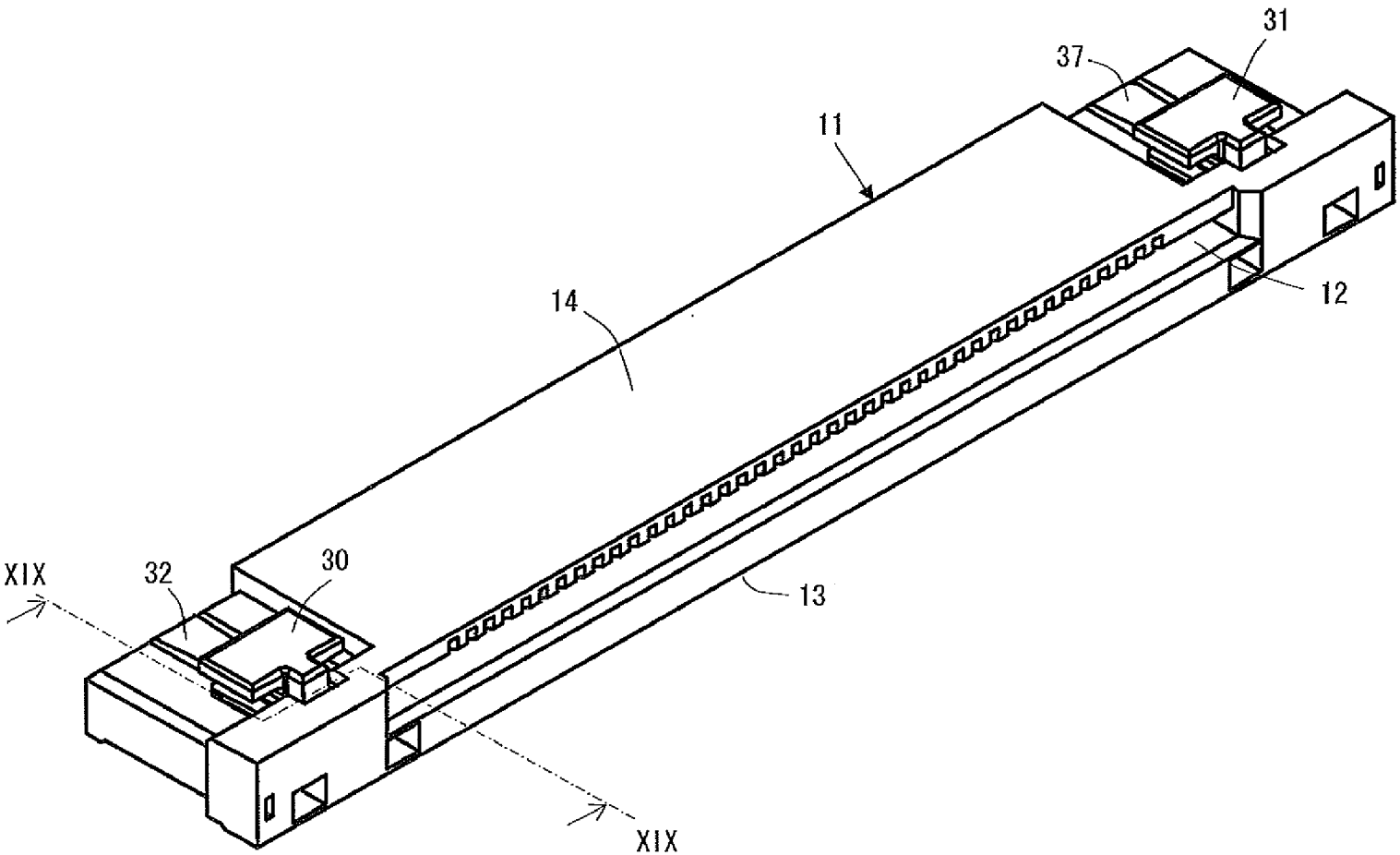
FIG. 17 is a schematic front, top and left side perspective view showing the housing provided to be employed in the embodiment shown in FIG. 1.
Figure 18:
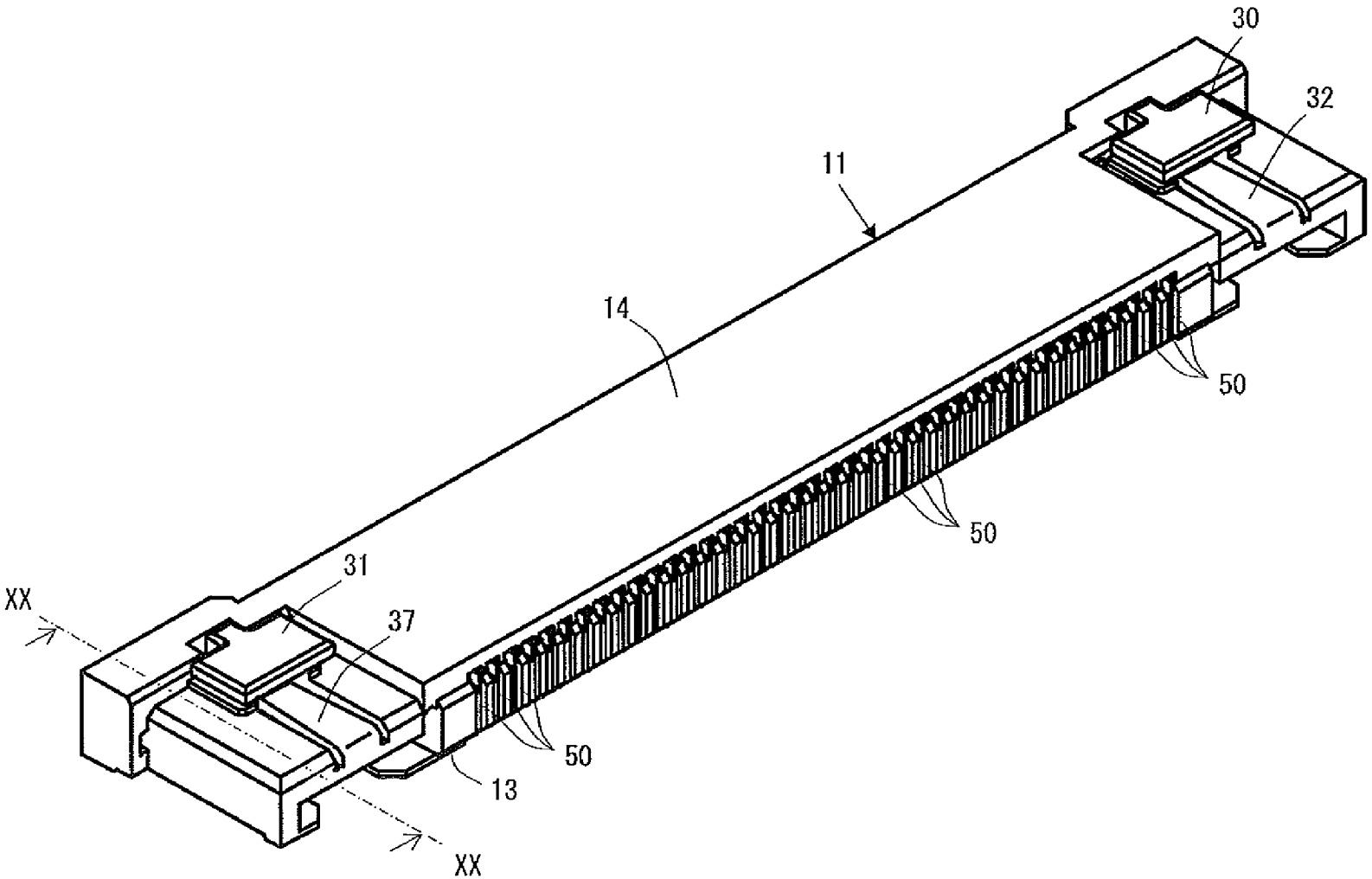
FIG. 18 is a schematic rear, top and right side perspective view showing the housing provided to be employed in the embodiment shown in FIG. 1.

The housing 11 is shown alone in each of FIGS. 17 and 18. FIG. 17 is a schematic front, top and left side perspective view showing the housing 11 and FIG. 18 is a schematic rear, top and right side perspective view showing the housing 11.

Referring to FIGS. 17 and 18, the housing 11 is provided with the opening 12 in the front end portion thereof and a plurality of grooves 50, in each of which the conductive contact 15 is put, in the rear end portion thereof. The housing 11 is provided also with the releasing member 30 supported by the connecting arm portion 32 extending from the rear end portion of the housing 11 at the left end portion of the housing 11 and the releasing member 31 supported by the connecting arm portion 37 extending from the rear end portion of the housing 11 at the right end portion of the housing 11.

Figure 19:
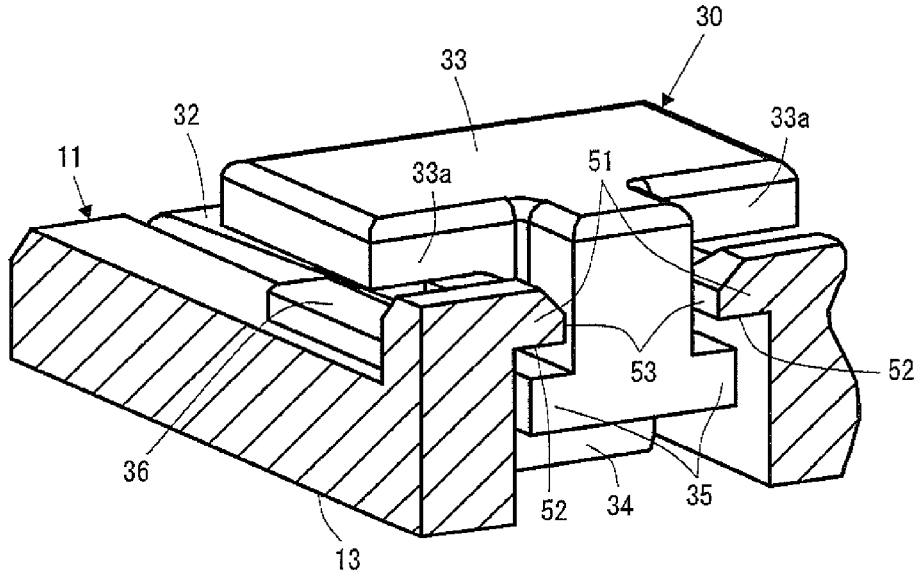
FIG. 19 is a schematic partial perspective view including a partial cross sectional view taken along line XIX-XIX on FIG. 17.
Figure 20:
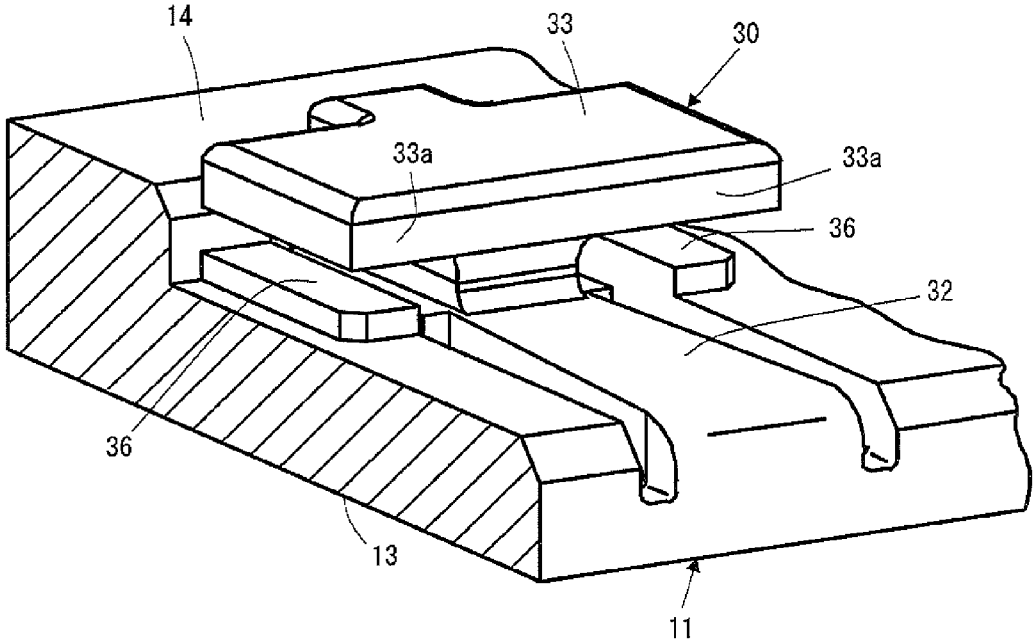
FIG. 20 is a schematic partial perspective view including a cross sectional view taken along line XX-XX on FIG. 18.

As shown in FIG. 19 showing the left end portion of the housing 11 including a cross section taken along line XIX-XIX on FIG. 17 and in FIG. 20 showing the left end portion of the housing 11 including a cross section taken along line XX-XX on FIG. 18, the first stopping portions 36 are provided at the left end portion of the housing 11 to be in close vicinity to the releasing member 30 so as to face respectively the overhangs 33*a* formed in the first end portion 33 of the releasing member 30 and a pair of projections 51 are provided to be positioned between each of the overhangs 33*a* and each of the overhangs 35 which are provided at the middle portion of the releasing member 30 between the first end portions 33 and the second end portion 34 of the releasing member 30.

A surface of the each of the projections 51 facing the overhang 35 provided at the middle portion of the releasing member 30 constitutes a second stopping portion 52 and a surface of each of the projections 51 facing a middle portion of the releasing member 30 between the first end portions 33 and the overhang 35 constitutes a third stopping portion 53.

Accordingly, at the left end portion of the housing 11, the first stopping portions 36 each facing the overhang 33*a* formed in the first end portion 33 of the releasing member 30, the second stopping portions 52 each facing the overhang 35 provided at the middle portion of the releasing member 30, and the third stopping portions 53 each facing the middle portion of the releasing member 30 between the first end portions 33 and the overhang 35, are provided to be in close vicinity to the releasing member 30.

Although illustrations are omitted, at the right end portion of the housing 11, first stopping portions each facing the overhang formed in the first end portion of the releasing member 31, second stopping portions each facing the overhang provided at the middle portion of the releasing member 31, and third stopping portions each facing the middle portion of the releasing member 31 between the first end portion and the overhang provided at the middle portion of the releasing member 31, are provided to be in close vicinity to the releasing member 31.

When the first end portion 33 of the releasing member 30 is excessively pushed toward the inside of the housing 11 and thereby the releasing member 30 is excessively moved in its entirety toward the first end surface 13 of the housing, at least one of the overhangs 33*a* formed in the first end portion 33 of the releasing member 30 comes into contact with the first stopping portion 36 provided at the left end portion of the housing 11 to be in close vicinity to the releasing member 30. The first stopping portion 36 is operative to limit the movement of the overhang 33*a* toward the inside of the housing 11 so as to cause the releasing member 30 to come to a standstill. As a result, the releasing member 30 with the first end portion 33 pushed excessively toward the inside of the housing 11 is surely prevented from being damaged.

Similarly, when the first end portion of the releasing member 31 is excessively pushed toward the inside of the housing 11 and thereby the releasing member 31 is excessively moved in its entirety toward the first end surface 13 of the housing, at least one of the overhangs formed in the first end portion of the releasing member 31 comes into contact with the first stopping portion provided at the right end portion of the housing 11 to be in close vicinity to the releasing member 31. The first stopping portion is operative to limit the movement of the overhang toward the inside of the housing 11 so as to cause the releasing member 31 to come to a standstill. As a result, the releasing member 31 with the first end portion pushed excessively toward the inside of the housing 11 is surely prevented from being damaged.

Further, when the first end portion 33 of the releasing member 30 is excessively pulled out of the housing 11 and thereby the releasing member 30 is excessively moved in its entirety toward the outside of the housing 11, at least one of the overhangs 35 provided at the middle portion of the releasing member 30 comes into contact with the second stopping portion 52 provided at the left end portion of the housing 11 to be in close vicinity to the releasing member 30. The second stopping portion 52 is operative to limit the movement of the overhang 35 toward the outside of the housing 11 so as to cause the releasing member 30 to come to a standstill. As a result, the releasing member 30 with the first end portion 33 thereof pulled excessively out of the housing 11 is surely prevented from being damaged.

Similarly, when the first end portion of the releasing member 31 is excessively pulled out of the housing 11 and thereby the releasing member 31 is excessively moved in its entirety toward the outside of the housing 11, at least one of the overhangs provided at the middle portion of the releasing member 31 comes into contact with the second stopping portion provided at the right end portion of the housing 11 to be in close vicinity to the releasing member 31. The second stopping portion is operative to limit the movement of the overhang toward the outside of the housing 11 so as to cause the releasing member 31 to come to a standstill. As a result, the releasing member 31 with the first end portion thereof pulled excessively out of the housing 11 is surely prevented from being damaged.

Besides, when the first end portion 33 of the releasing member 30 is excessively pushed in the longitudinal direction of the housing 11, along which the conductive contacts 15 are arranged, and thereby the releasing member 30 is excessively moved in its entirety in the longitudinal direction of the housing 11, the middle portion of the releasing member 30 between the first end portion 33 and one of the overhangs 35 comes into contact with one of the third stopping portions 53 provided at the left end portion of the housing 11 to be in close vicinity to the releasing member 30. The third stopping portion 53 is operative to limit the movement of the middle portion of the releasing member 30 in the longitudinal direction of the housing 11 so as to cause the releasing member 30 to come to a standstill. As a result, the releasing member 30 with the first end portion 33 pushed excessively in the longitudinal direction of the housing 11 is surely prevented from being damaged.

Similarly, when the first end portion of the releasing member 31 is excessively pushed in the longitudinal direction of the housing 11 and thereby the releasing member 31 is excessively moved in its entirety in the longitudinal direction of the housing 11, the middle portion of the releasing member 31 between the first end portion and one of the overhangs provided at the middle portion of the releasing member 30 comes into contact with one of the third stopping portions provided at the right end portion of the housing 11 to be in close vicinity to the releasing member 31. The third stopping portion is operative to limit the movement of the middle portion of the releasing member 31 in the longitudinal direction of the housing 11 so as to cause the releasing member 31 to come to a standstill. As a result, the releasing member 31 with the first end portion pushed excessively in the longitudinal direction of the housing 11 is surely prevented from being damaged.

With the electrical connector 10 constituting the embodiment of electrical connector according to the present invention as described above, when the FFC 40 is inserted into the housing 11 thorough the opening 12 provided thereon, such a condition that the connecting terminals 43 provided on the FFC 40 inserted in the housing 11 are electrically connected through the conductive contacts 15 arranged on the housing 11 with the circuit terminals provided on the solid circuit board on which the housing 11 is mounted and each of the holding member 20 formed in the reinforcing mount member 16 provided at the left end portion of the housing 11 and the holding member formed in the reinforcing mount member 17 provided at the right end portion of the housing 11 engages with the FFC 40 inserted in the housing 11 to hold appropriately the same, can be obtained automatically.

Further, it is not required, for causing each of the holding member 20 formed in the reinforcing mount member 16 and the holding member formed in the reinforcing mount member 17 to be put in engagement with the FFC 40 inserted in the housing 11 to hold the same and then to be released by the releasing members 30 and 31 provided in the housing 11 from the engagement with the FFC 40 to put the same in free, to provide on the housing 11 an actuator rotatable in regard to the housing 11 or the like, to provide a conductive shell covering partially the housing 11 or to set a conductive shell to be rotatable in regard to the housing 11. Accordingly, the electrical connector 10 can be constituted with a relatively small number of constitutive parts and at a production cost reduced effectively.

In addition, since each of the holding member 20 formed in the reinforcing mount member 16 and the holding member formed in the reinforcing mount member 17 is released from the engagement with the FFC 40 inserted in the housing 11 when the first end portion 33 of the releasing member 30 and the first end portion of the releasing member 31, each of which projects out of the housing 11, is pushed toward the inside of the housing 11, each of the holding member 20 formed in the reinforcing mount member 16 and the holding member formed in the reinforcing mount member 17 can be released from the engagement with the FFC 40 inserted in the housing 11 by extremely simple and easy operations and it is not necessary for carrying out such operations to provide an undesirable open space around each of the releasing members 30 and 31.

Going into details of the electrical connector 10 thus constituted, since the second end portion 34 of the releasing member 30 is operative to deform resiliently the resilient arm portion 22 of the holding member 20 formed in the reinforcing mount member 16 to shift the engaging portion 23 of the holding member 20 in its position so that the engaging portion 23 of the holding member 20 is released from the engagement with the engaging edged recess 44 provided on the FFC 40 inserted in the housing 11 when the first end portion 33 of the releasing members 30 is pushed toward the inside of the housing 11 under the condition wherein the engaging portion 23 of the holding member 20 supported to be shiftable in its position by the resilient arm portion 22 of the holding member 20 is put in engagement with the engaging edged recess 44 provided on the FFC 40 inserted in the housing 11, and the second end portion of the releasing member 31 is operative to deform resiliently the resilient arm portion of the holding member formed in the reinforcing mount member 17 to shift the engaging portion of the holding member formed in the reinforcing mount member 17 in its position so that the engaging portion of the holding member formed in the reinforcing mount member 17 is released from the engagement with the engaging edged recess 45 provided on the FFC 40 inserted in the housing 11 when the first end portion of the releasing members 31 is pushed toward the inside of the housing 11 under the condition wherein the engaging portion of the holding member formed in the reinforcing mount member 17 supported to be shiftable in its position by the resilient arm portion of the holding member formed in the reinforcing mount member 17 is put in engagement with the engaging edged recess 45 provided on the FFC 40 inserted in the housing 11, the FFC 40 inserted in the housing 11 can be easily put in the holding by the holding member 20 formed in the reinforcing mount member 16 and the holding member formed in the reinforcing mount member 17 and then surely released from the holding by the holding members 20 formed in the reinforcing mount member 16 and the holding member formed in the reinforcing mount member 17.

What is claimed is:

1. An electrical connector comprising;

a housing provided to be mounted on a solid circuit board with a first end surface facing the solid circuit board, a second end surface opposite to the first end surface to be open to a space on the solid circuit board and an opening through which a flat circuit device is inserted in the housing, a plurality of conductive contacts arranged on the housing to be electrically connected respectively with circuit terminals provided on the solid circuit board and positioned to correspond respectively to connecting terminals provided on the flat circuit device inserted in the housing through the opening provided thereon, and reinforcing mount members provided respectively on end portions of the housing in a direction along which the conductive contacts are arranged to be used for mounting the housing on the solid circuit board, wherein a holding member is formed in the reinforcing mount member to extend into the housing for engaging with the flat circuit device inserted in the housing to hold the same, a releasing member is formed in the housing to be movable with a first end portion thereof operative to project out of the housing on the side of the second end surface of the housing and a second end portion thereof operative to engage with the holding member, and the releasing member is moved toward the first end surface of the housing so that the second end portion of the releasing member causes the holding member to be released from engagement with the flat circuit device inserted in the housing when the first end portion of the releasing member is pushed toward the inside of the housing under a condition wherein the holding member is put in the engagement with the flat circuit device inserted in the housing.

2. An electrical connector according to claim 1, wherein the holding member comprises an engaging portion for engaging with an engaging edged portion provided on the flat circuit device inserted in the housing through the opening provided thereon to hold the flat circuit device and a resilient arm portion for supporting the engaging portion to be shiftable in position in the housing, and the second end portion of the releasing member is operative to engage with the resilient arm portion of the holding member.

3. An electrical connector according to claim 2, wherein the second end portion of the releasing member is operative to deform resiliently the resilient arm portion of the holding member to shift the engaging portion of the holding member in its position so that the engaging portion of the holding member is released from engagement with the engaging edged portion provided on the flat circuit device inserted in the housing when the first end portion of the releasing member is pushed toward the inside of the housing under a condition wherein the engaging portion of the holding member is put in the engagement with the engaging edged portion provided on the flat circuit device inserted in the housing.

4. An electrical connector according to claim 2, wherein the resilient arm portion of the holding member is operative to hit with resilient force against a portion of the housing when the engaging portion of the holding member comes to the engagement with the engaging edged portion provided on the flat circuit device inserted in the housing.

5. An electrical connector according to claim 2, wherein the engaging portion of the holding member has an upper end thereof on which a slanted end plane is formed to ascend gradually in a direction along which the flat circuit device is inserted into the housing through the opening provided thereon and the upper end of the engaging portion of the holding member is operative to engage with the engaging edged portion provided on the flat circuit device inserted in the housing.

6. An electrical connector according to claim 2, wherein an end portion of the engaging portion of the holding member on the side of the opening provided on the housing is positioned in close vicinity to a portion of the housing in which the opening is formed.

7. An electrical connector according to claim 1, wherein a first stopping portion is provided on the housing for engaging with a portion of the releasing member to limit a movement of the same so as to cause the releasing member to come to a standstill when the first end portion of the releasing member is excessively pushed toward the inside of the housing and thereby the releasing member is excessively moved toward the first end surface of the housing.

8. An electrical connector according to claim 1, wherein a second stopping portion is provided on the housing for engaging with a portion of the releasing member to limit a movement of the same so as to cause the releasing member to come to a standstill when the first end portion of the releasing member is excessively pulled out of the housing and thereby the releasing member is excessively moved toward the outside of the housing.

9. An electrical connector according to claim 1, wherein a third stopping portion is provided on the housing for engaging with a portion of the releasing member to limit a movement of the same so as to cause the releasing member to come to a standstill when the first end portion of the releasing member is excessively pushed in a direction along which the conductive contacts are arranged and thereby the releasing member is excessively moved in the direction along which the conductive contacts are arranged.

* * * * *